US011813212B2

(12) United States Patent
Hamilton et al.

(10) Patent No.: US 11,813,212 B2
(45) Date of Patent: Nov. 14, 2023

(54) ASSISTIVE MOBILITY DEVICE

(71) Applicant: RAPADAPT CORPORTION, Webster, NY (US)

(72) Inventors: Devin Hamilton, Rochester, NY (US); Robert Karz, Webster, NY (US)

(73) Assignee: RAPADAPT CORPORATION, Webster, NY (US)

( * ) Notice: Subject to any disclaimer, the term of this patent is extended or adjusted under 35 U.S.C. 154(b) by 1250 days.

(21) Appl. No.: 16/377,165

(22) Filed: Apr. 6, 2019

(65) Prior Publication Data

US 2020/0315882 A1 Oct. 8, 2020

(51) Int. Cl.
*A61G 5/10* (2006.01)
*A61G 5/12* (2006.01)

(52) U.S. Cl.
CPC ..... *A61G 5/1059* (2013.01); *A61G 5/1043* (2013.01); *A61G 5/128* (2016.11)

(58) Field of Classification Search
CPC .... A61G 5/1059; A61G 5/128; A61G 5/1043; A61G 5/1045; A61G 5/1075
See application file for complete search history.

(56) References Cited

U.S. PATENT DOCUMENTS 3,589,769 A 6/1971 Bressler
4,120,532 A * 10/1978 Clanan ..... A61G 5/12 297/423.37
4,231,614 A 11/1980 Shaffer
4,456,086 A 6/1984 Wier
4,555,121 A * 11/1985 Lockard ..... A61G 5/00 280/30
4,589,699 A 5/1986 Dungan
4,679,810 A * 7/1987 Kimball ..... B62D 61/065 182/127
4,744,578 A 5/1988 Stearns
4,793,655 A 12/1988 Kvalheim
4,848,841 A 7/1989 Giselsson
5,137,102 A 8/1992 Houston
5,346,280 A 9/1994 Deumite
5,366,036 A 11/1994 Perry
5,513,867 A 5/1996 Bloswick
5,520,402 A 5/1996 Nestor
5,520,403 A 5/1996 Bergstrom
5,720,462 A 2/1998 Broderson
6,039,402 A 3/2000 Nemoto
6,105,706 A * 8/2000 Cooper ..... B60N 2/24 297/344.11
6,125,957 A 10/2000 Kauffmann
6,416,272 B1 7/2002 Suehiro
(Continued)

FOREIGN PATENT DOCUMENTS

DE 2625046 A1 12/1977
EP 0815822 B1 1/1999
(Continued)

*Primary Examiner* — Minnah L Seoh
*Assistant Examiner* — Harold Eric Pahlck, III
(74) *Attorney, Agent, or Firm* — Michael A. Butler

(57) ABSTRACT

An assistive mobility device comprising a seat and knee pad, the knee pad arranged to lift a person in a kneeling position into said seat and stabilize said person in said seat, maintaining supportive contact with the person's legs. The seat and knee pad each have an independent rotational tilt adjustment and can be raised and lowered together.

17 Claims, 25 Drawing Sheets

(56) References Cited

U.S. PATENT DOCUMENTS

| | | | | |
|---|---|---|---|---|
| 6,467,785 | B2 | 10/2002 | Toppses | |
| 7,921,953 | B2 | 4/2011 | Irvine | |
| 8,172,023 | B1 | 5/2012 | Irvine | |
| 8,403,352 | B2 | 3/2013 | Hunziker | |
| 8,522,907 | B1 | 9/2013 | Irvine | |
| 8,567,804 | B1 | 10/2013 | Hoenhause | |
| 9,016,715 | B2 | 4/2015 | Moliner | |
| 9,757,291 | B2 | 9/2017 | Wohlen | |
| 2006/0087166 | A1 | 4/2006 | Trippensee | |
| 2014/0327231 | A1* | 11/2014 | Perk ..... | A61G 5/14 280/647 |
| 2016/0158079 | A1 | 9/2016 | Pempei | |
| 2017/0100290 | A1 | 4/2017 | Vigentini | |

FOREIGN PATENT DOCUMENTS

| | | | |
|---|---|---|---|
| EP | 1600134 | A1 | 11/2005 |
| EP | 2039335 | B1 | 3/2009 |
| FR | 2529456 | A1 | 1/1984 |

* cited by examiner

ASSISTIVE MOBILITY DEVICE

CROSS REFERENCE TO RELATED APPLICATIONS

Cross reference is made to co-pending application MN 100002, "ASSISTIVE MOBILITY DEVICE", filed contemporaneously with the instant application and which is incorporated in its entirety herein for all purposes.

BACKGROUND

Wheelchairs and other assistive mobility devices are an essential tool to provide mobility and independence to individuals with a variety of impairments. While such devices have existed for many years, there is still a need for devices that allow an individual to mount and dismount them without the aid of another person. An additional problem with many such devices is that once a person has mounted them, there is insufficient ability to adjust the device to assume different positions. This may result in constant pressure on isolated portions of the skin where the individual rests on the device. This constant pressure for extended periods of time is known to cause bedsores that can bleed and become infected. There is a need for a wheelchair that enables a person to easily change their position in the chair to reduce or eliminate bedsores. A further problem with many devices is that they are not arranged to allow an individual to work closely to a bench or table. Further there is need for a device wherein the occupant may adjust posture for reasons of comfort and ergonomics whether sitting, working or moving. Accordingly, the instant application discloses embodiments that addresses these problems and provides other benefits as disclosed herein.

SUMMARY OF THE INVENTION

In one embodiment of the instant application there is provided a wheelchair comprising: a seat frame having a front, a rear, a first side and a second side; a first lift mechanism arranged to vertically move said seat frame; a seat having a front and a rear wherein said seat is pivotally coupled to said seat frame allowing said front of said seat to move upward and downward in an arcuate path; a second lift mechanism arranged to pivotally move said seat; a lift platform, movably connected to said seat frame; and, a third lift mechanism arranged to move said lift platform.

In one embodiment of the instant application there is provided an assistive mobility device having a front, a rear a first side and a second side comprising: a seat frame, said seat frame comprising a first seat frame member extending from said front toward said rear and a first vertical seat frame member attached to and extending upward from said first seat frame member, said seat frame further comprising a second seat frame member extending from said front toward said side, and a second vertical seat frame member attached to and extending upward from said second seat frame member; a first lift mechanism arranged to vertically move said seat frame; a seat movably mounted to said seat frame; a second lift mechanism arranged to move said seat pad; a knee pad movably connected to said seat frame, said knee pad having a front and a rear, said front of said knee pad extending out from said front of said seat frame; and, a third lift mechanism to move said knee pad arranged to pivotally move said front of said knee pad upward and downward in an arcuate path.

Thus has been described, rather broadly, some of the features of the invention in order that the present application may be better understood. Additional features of the invention will be described herein that will form the subject matter of the claims. In this respect, before explaining at least one embodiment of the invention in detail, it is to be understood that the invention is not limited in its application to the details of construction or to the arrangements of the components set forth in the instant application. The invention is capable of other embodiments and of being practiced and carried out in various ways. It is to be understood that the phraseology and terminology employed herein are for the purpose of enabling the description and should not be construed as limiting.

BRIEF DESCRIPTION OF THE DRAWINGS

The features of the application can be better understood with reference to the drawings described below and to the claims. The drawings are not necessarily to scale, emphasis instead generally being placed upon illustrating the principles described herein. In the drawings, like numerals are used to indicate like parts throughout the various views.

DETAILED DESCRIPTION OF THE INVENTION

Figure 1A:
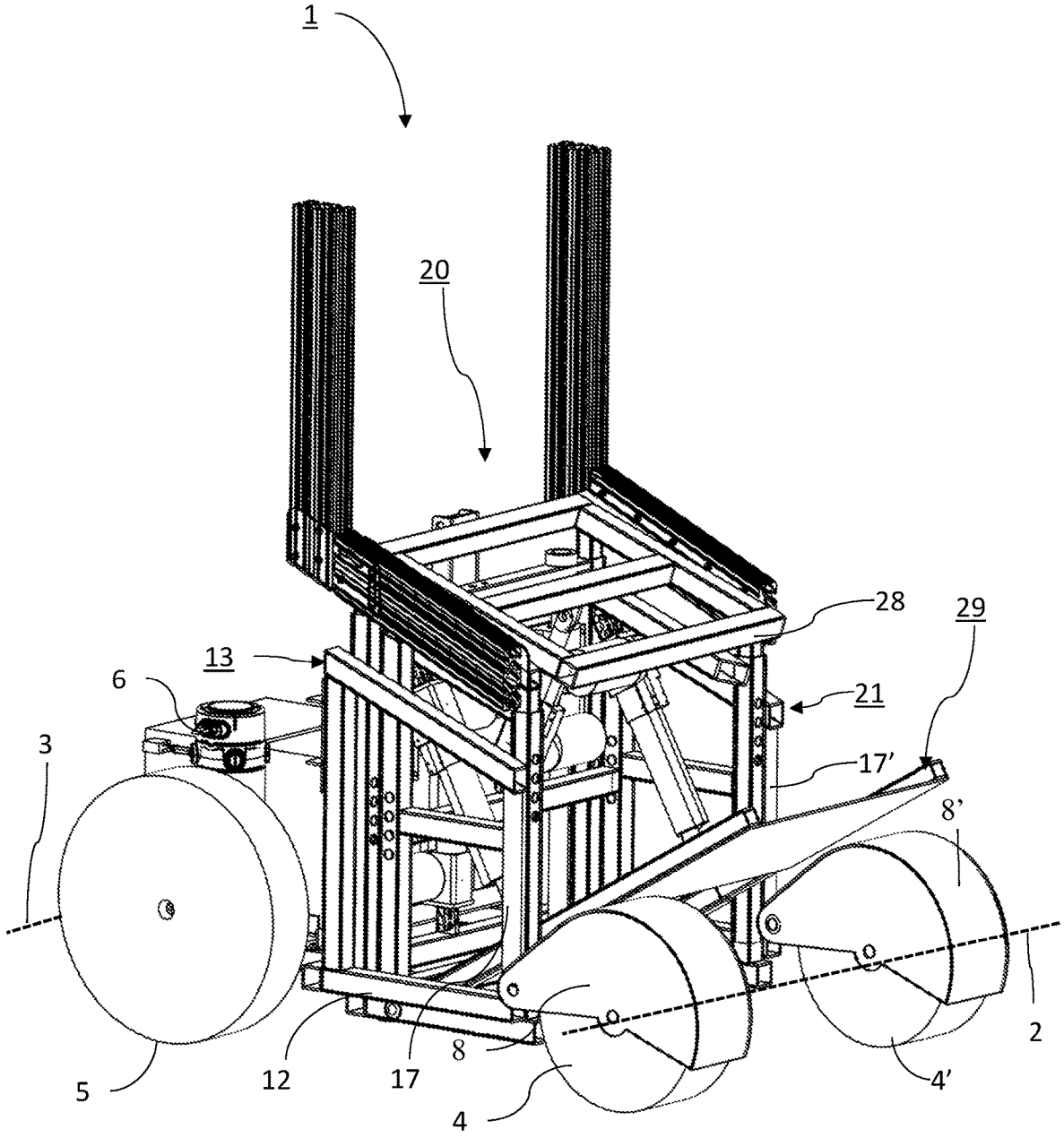
FIG. 1A depicts a side view of a first embodiment of a wheelchair in accordance with the instant application.
Figure 1B:
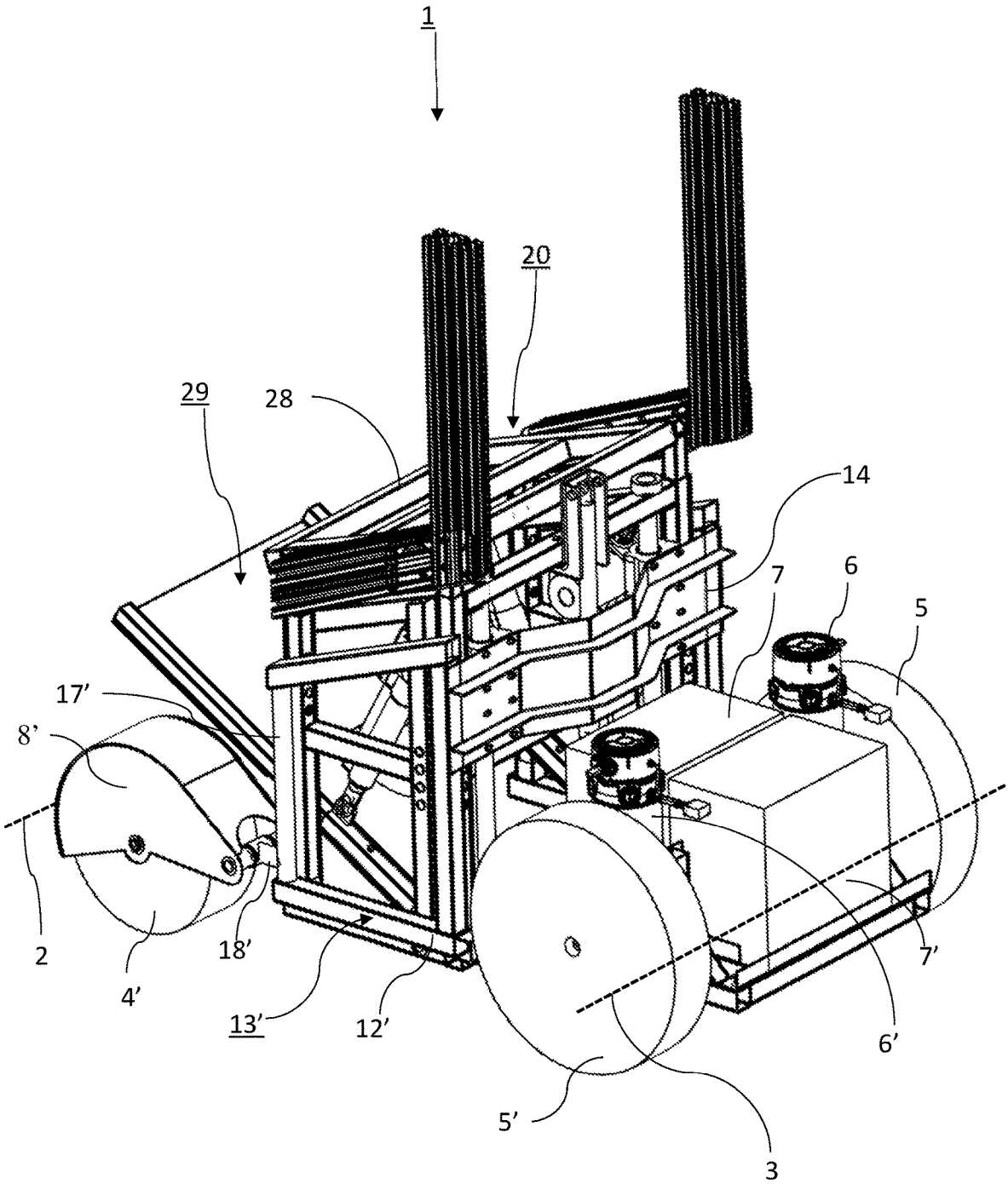
FIG. 1B depicts a side view of a first embodiment of a wheelchair in accordance with the instant application.

FIG. 1A and FIG. 1B show an exemplary embodiment of a wheelchair 1 in accordance with the instant application. Wheelchair 1 has a front side 2 and a rear side 3. Support frame 11 (reference FIG. 2A) is used to mount the structural elements of wheelchair 1, including front wheels 4,4', front wheel housings 8,8', rear wheels 5,5', seat assembly 20 (reference FIG. 3), batteries 7,7' and motors 6,6'. As shown with reference to FIG. 1C, and described in more detail herein, front wheels 4, 4' and front wheel housings 8,8' may be rotate toward the rear side 3 of wheelchair 1 to facilitate mounting and dismounting wheelchair 1 via lift platform 29. Lift platform 29, alternately referred to as a knee pad frame, extends outward from the front side of seat frame 21 (reference FIG. 3). Wheels 4,4' and 5,5' may optionally be attached to wheelchair 1 using shock absorbers (not shown) such as by way of example and not limitation, air springs, or coil springs.

Figure 3:
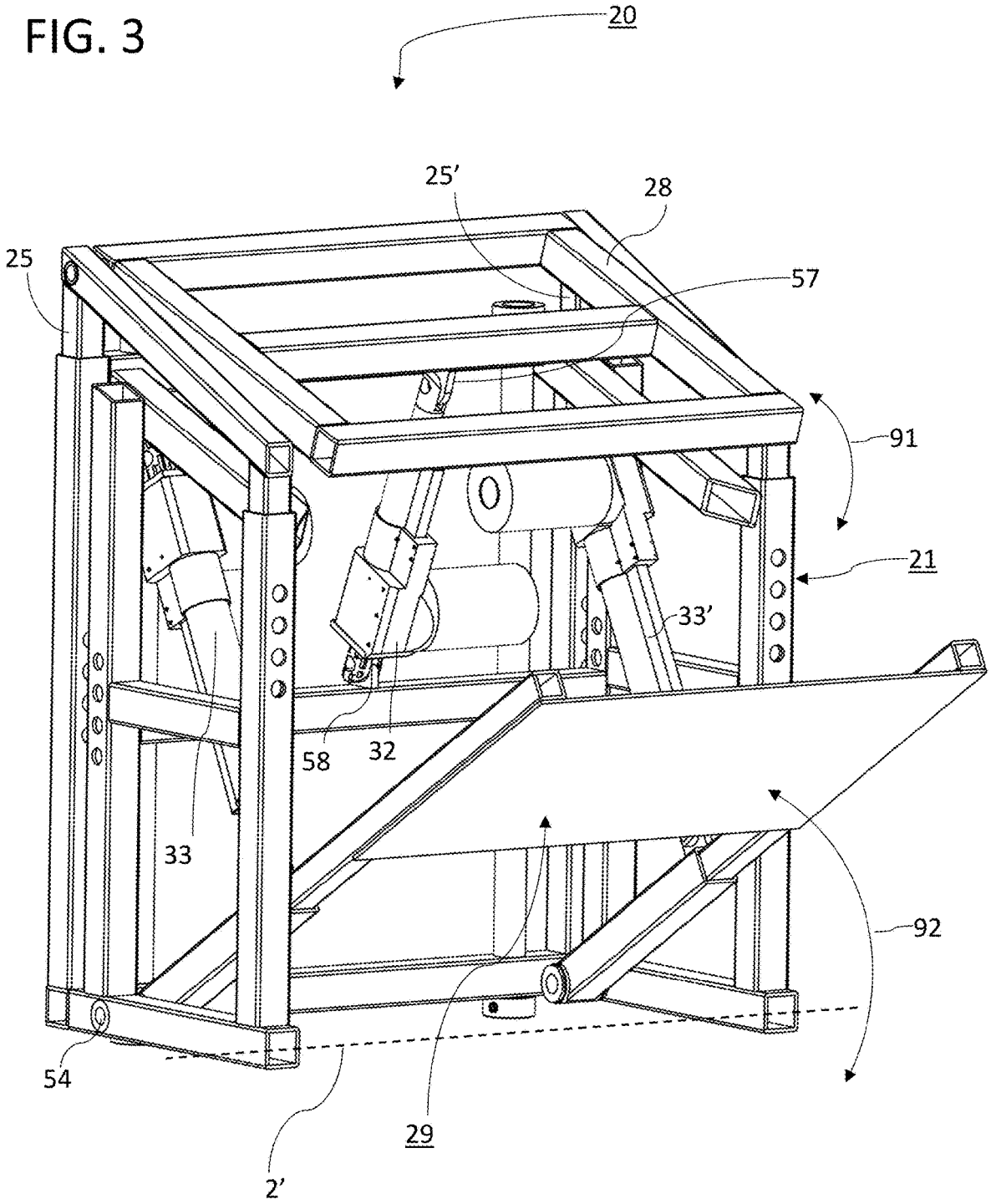
FIG. 3 depicts a seat assembly portion of a wheelchair in accordance with the instant application.
Figure 5A:
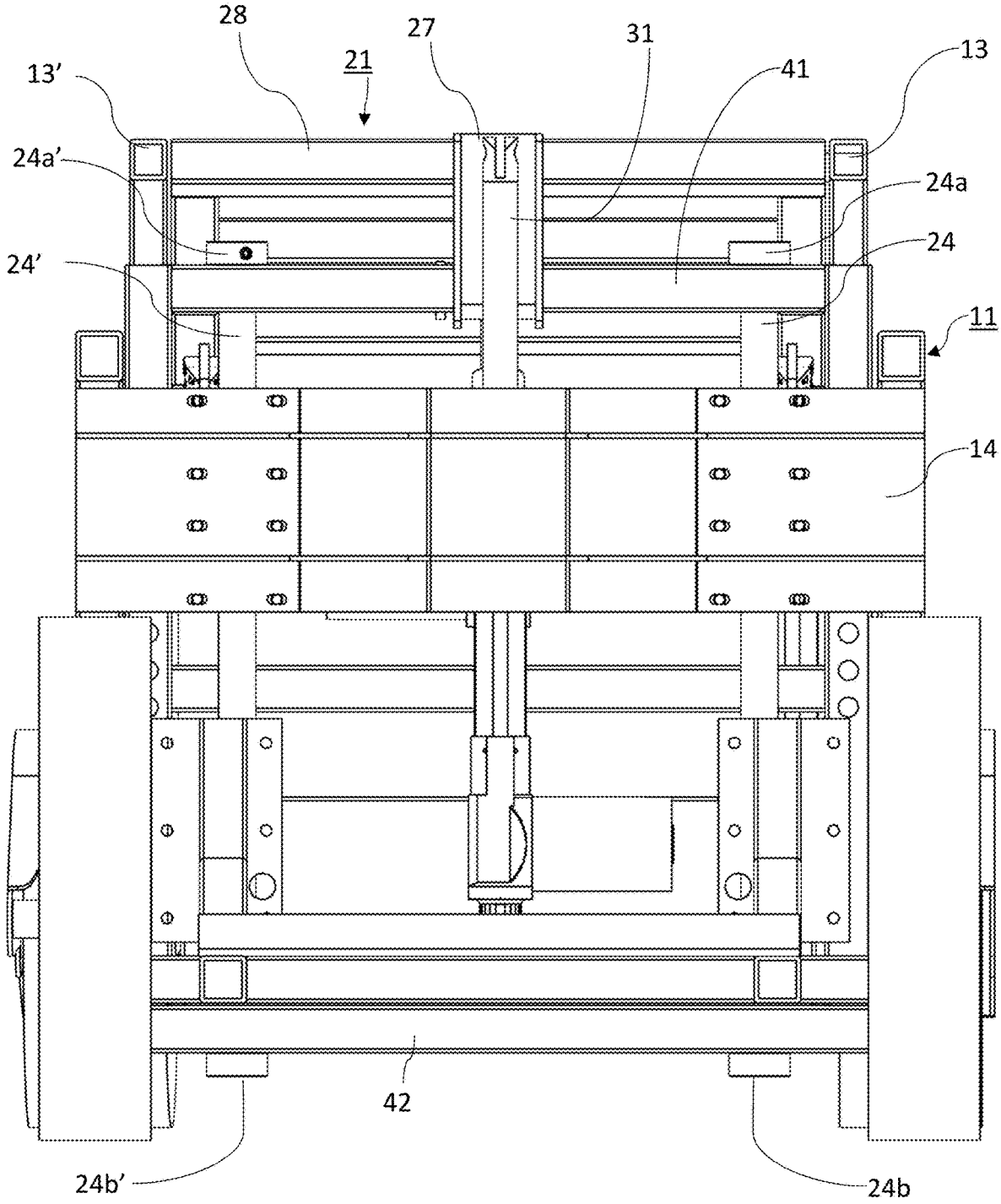
FIG. 5A depicts a rear view of a wheelchair in accordance with the instant application with selected components removed to better show certain structural elements.
Figure 5B:
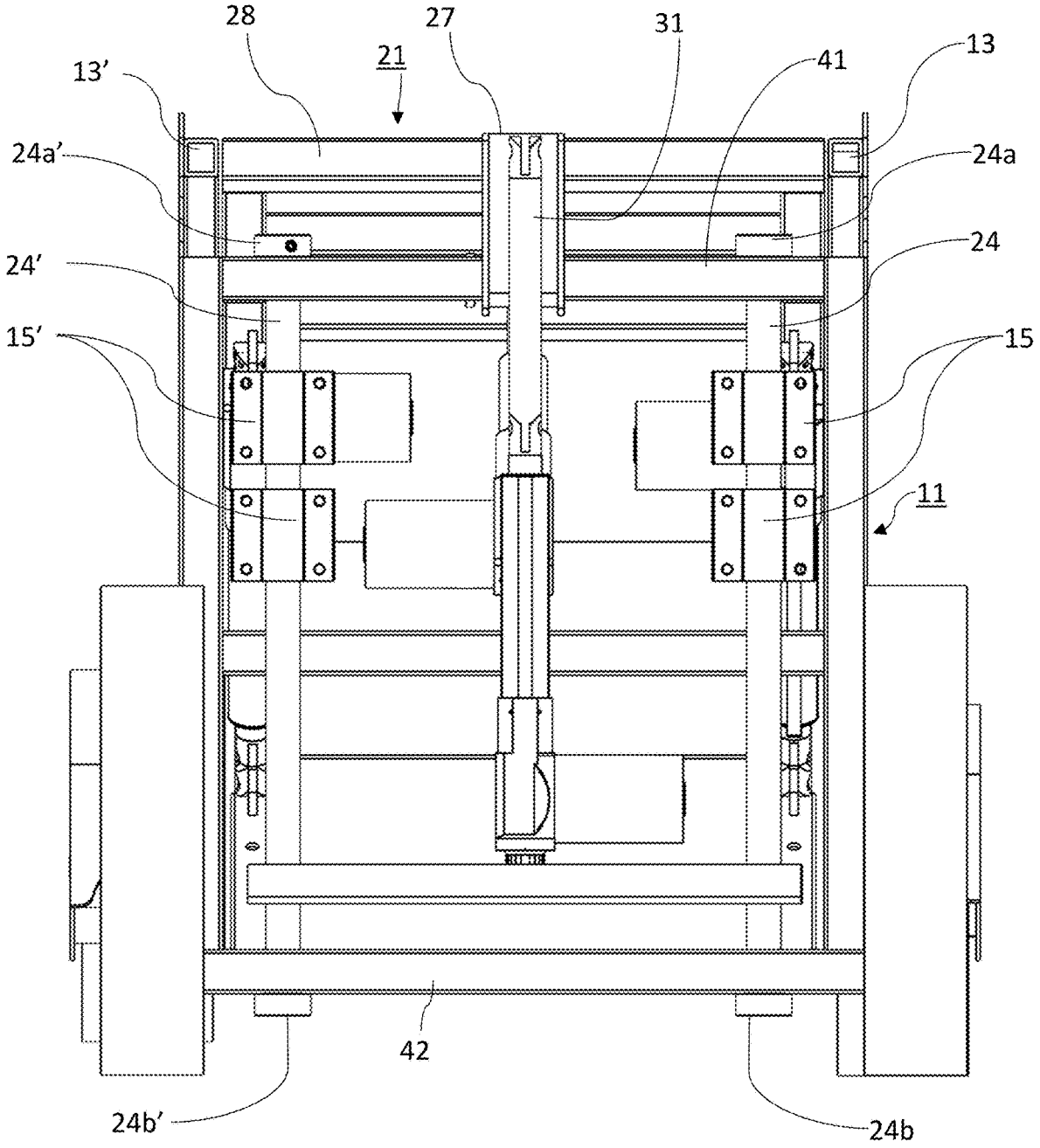
FIG. 5B depicts a rear view of a wheelchair in accordance with the instant application with selected components removed to better show certain structural elements.

In a representative embodiment in accordance with the instant applications, batteries 7, 7' are twelve (12) volt, sealed, group 4 batteries arranged electrically in series to provide 24V DC (twenty-four volt direct current) power to motors 6, 6' and lift mechanisms 31, 32, 33 and 33' as described in more detail herein with respect to FIGS. 3, 5A and 5B. In a representative embodiment in accordance with the instant application motors 6, 6' comprise direct current motors with high starting torque such as by way of example and not limitation an Electrocraft® MP36 series motor coupled with an integral brake such as by way of example and not limitation, a Warner Electric® WR225 static holding brake.

Support frame 11 (reference FIG. 2A) comprises horizontal support frame members 12, 12' extending from the front 2 of support frame 11 toward the rear 3 of the support frame 11 where they are attached to frame member 16. Lift mechanism attachment member 81 is located midway between the two ends of frame member 16. Vertical support frame members 13, 13' (reference FIG. 2C) are attached respectively to horizontal support frame members 12 and 12'. A rear bracket 14 extends between and is attached to vertical support frame members 13, 13'. Seat assembly 20 (reference FIG. 3) is positioned between vertical support frame members 13, 13' and forward of rear bracket 14. Front wheel housings 8, 8' are mounted to wheel mounts 18, 18' of vertical support members 13, 13' respectively.

Wheel mounts 18, 18' are attached to frame members 17, 17' of vertical support frame members 13, 13'. Frame member 17 is pivotally attached to support frame 11 frame members 12 and 19. Similarly, frame member 17' is attached to support frame 11 frame members 12' and 19. The pivotal attachment may be accomplished using any means known to those skilled in the art, including by way of example and not limitation, bearings, bushings, sleeves and the like.

Figure 1C:
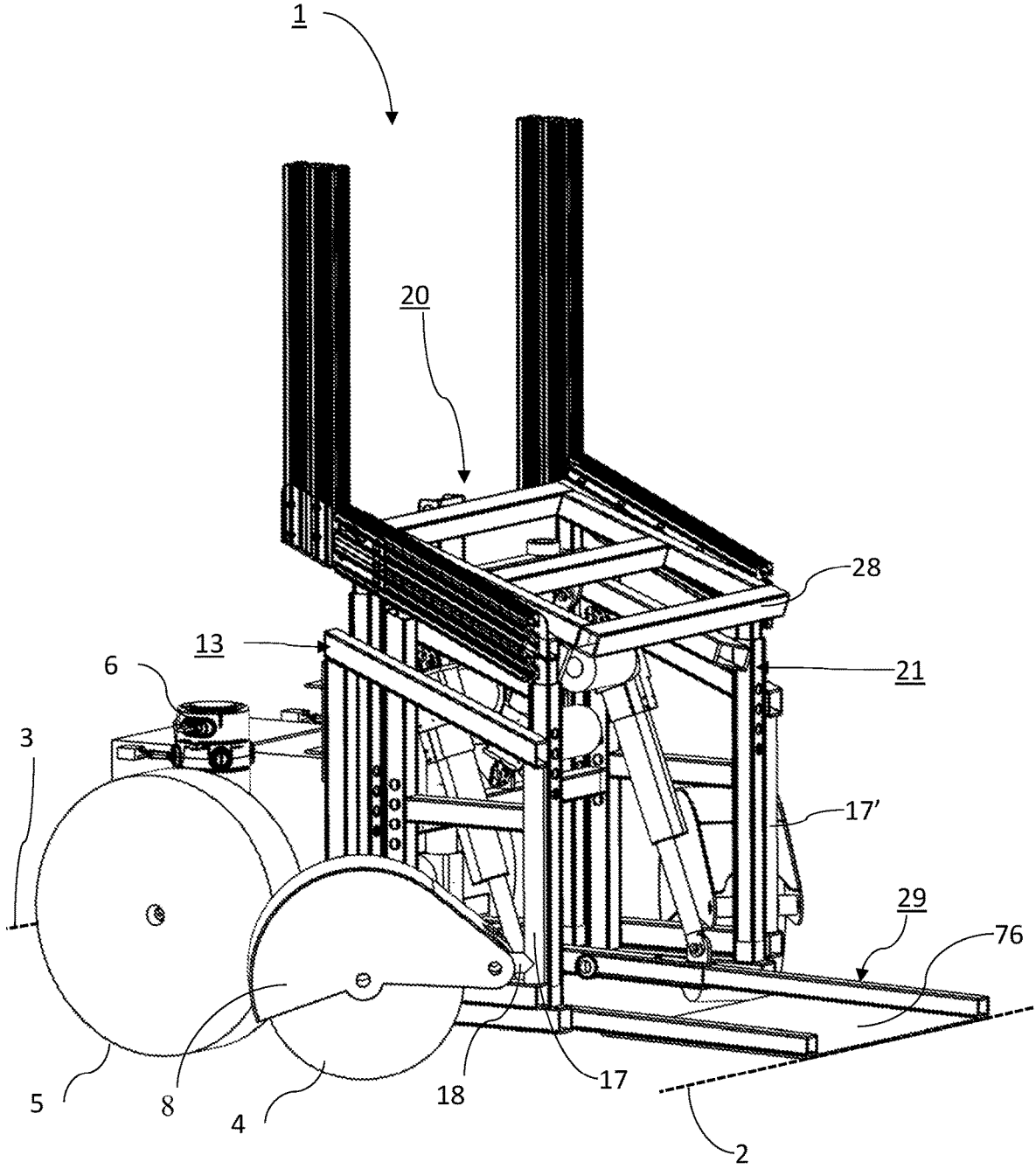
FIG. 1C depicts a side view of a first embodiment of a wheelchair in accordance with the instant application wherein the front wheels are rotated toward the rear of the wheelchair to provide access to the lifting platform.
Figure 1D:
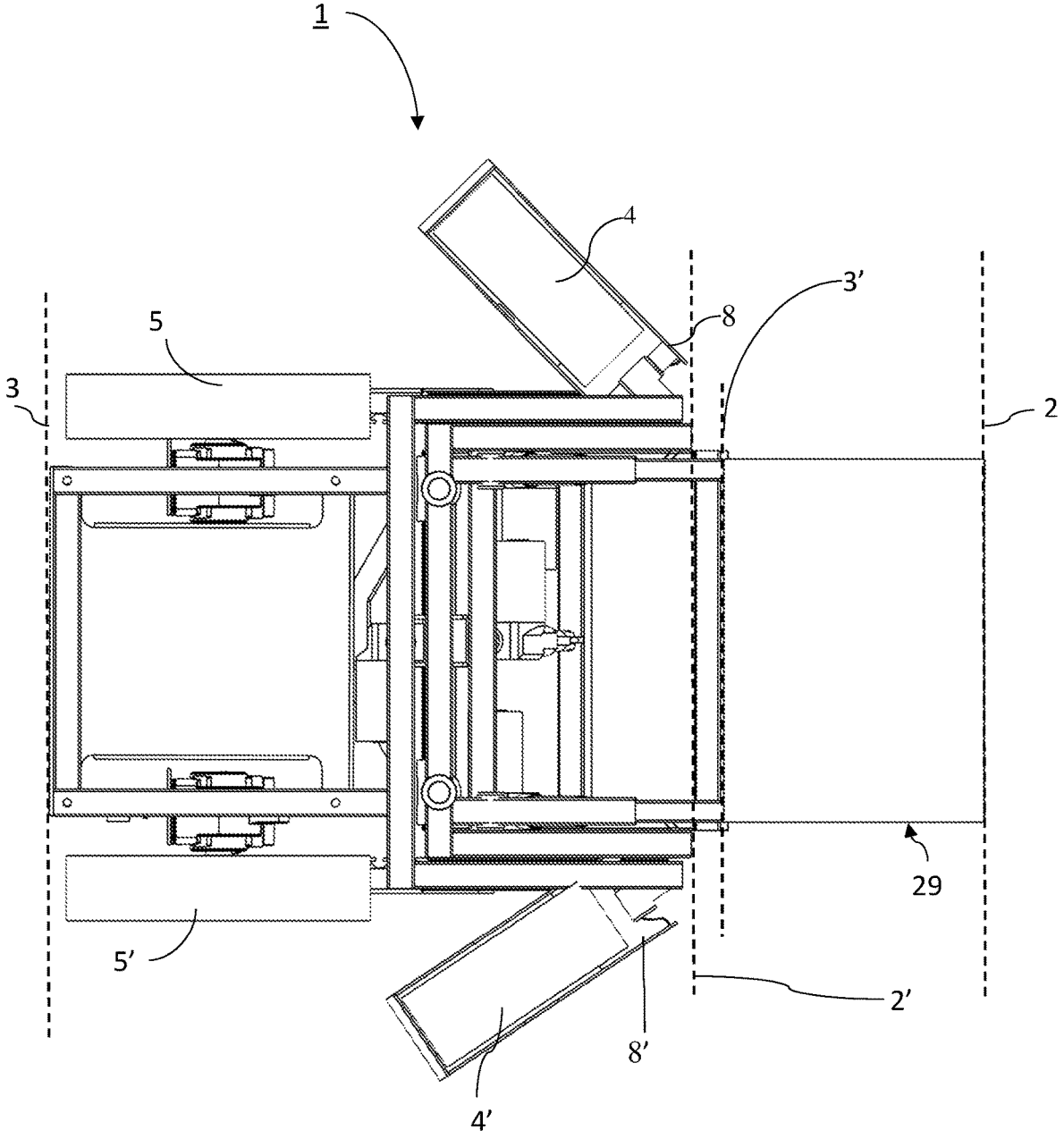
FIG. 1D depicts a bottom view of a first embodiment of a wheelchair in accordance with the instant application wherein the front wheels are rotated toward the rear of the wheelchair to provide access to the lifting platform.
Figure 2A:
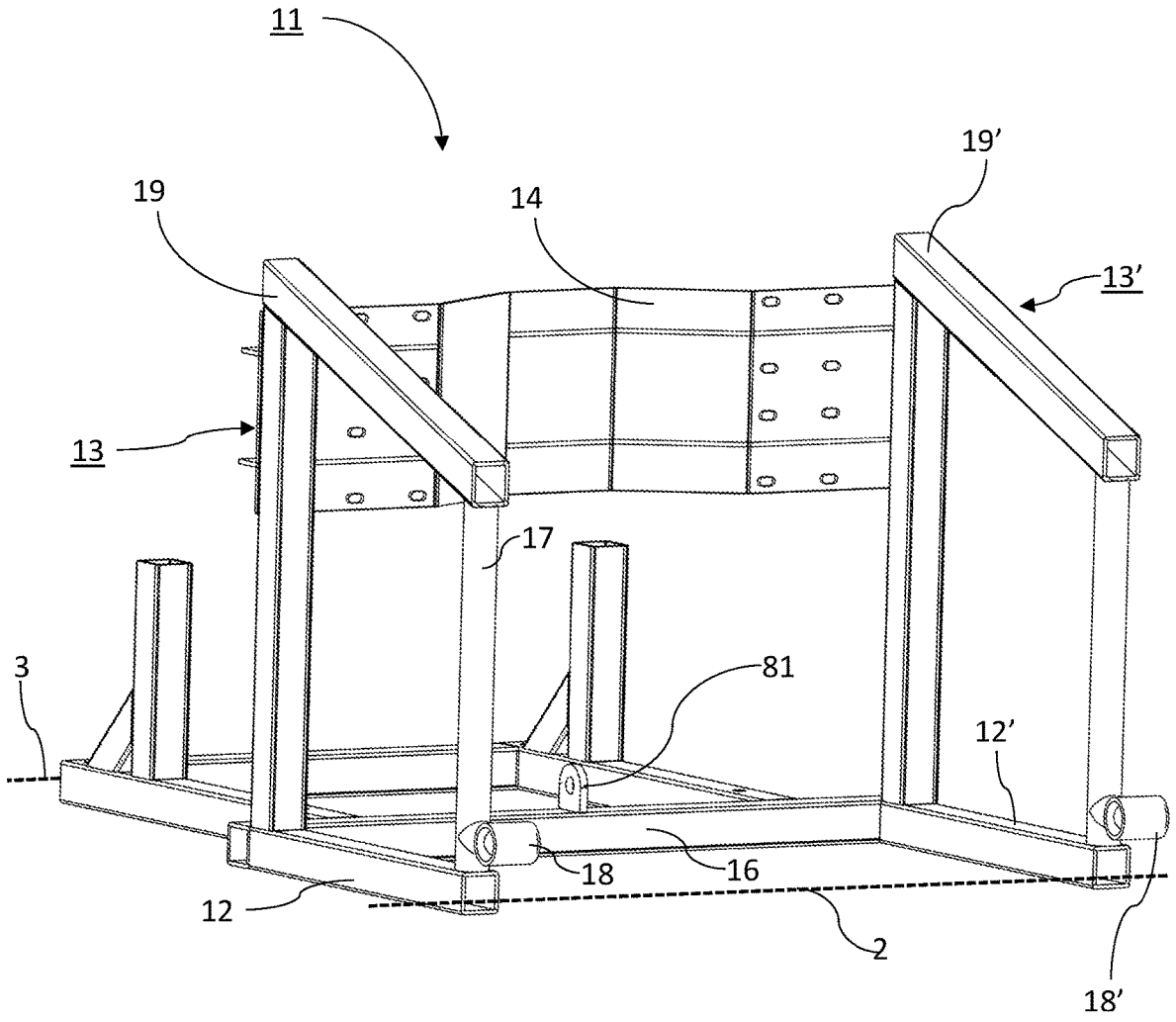
FIG. 2A depicts a support frame portion of a first embodiment of a wheelchair in accordance with the instant application.
Figure 2B:
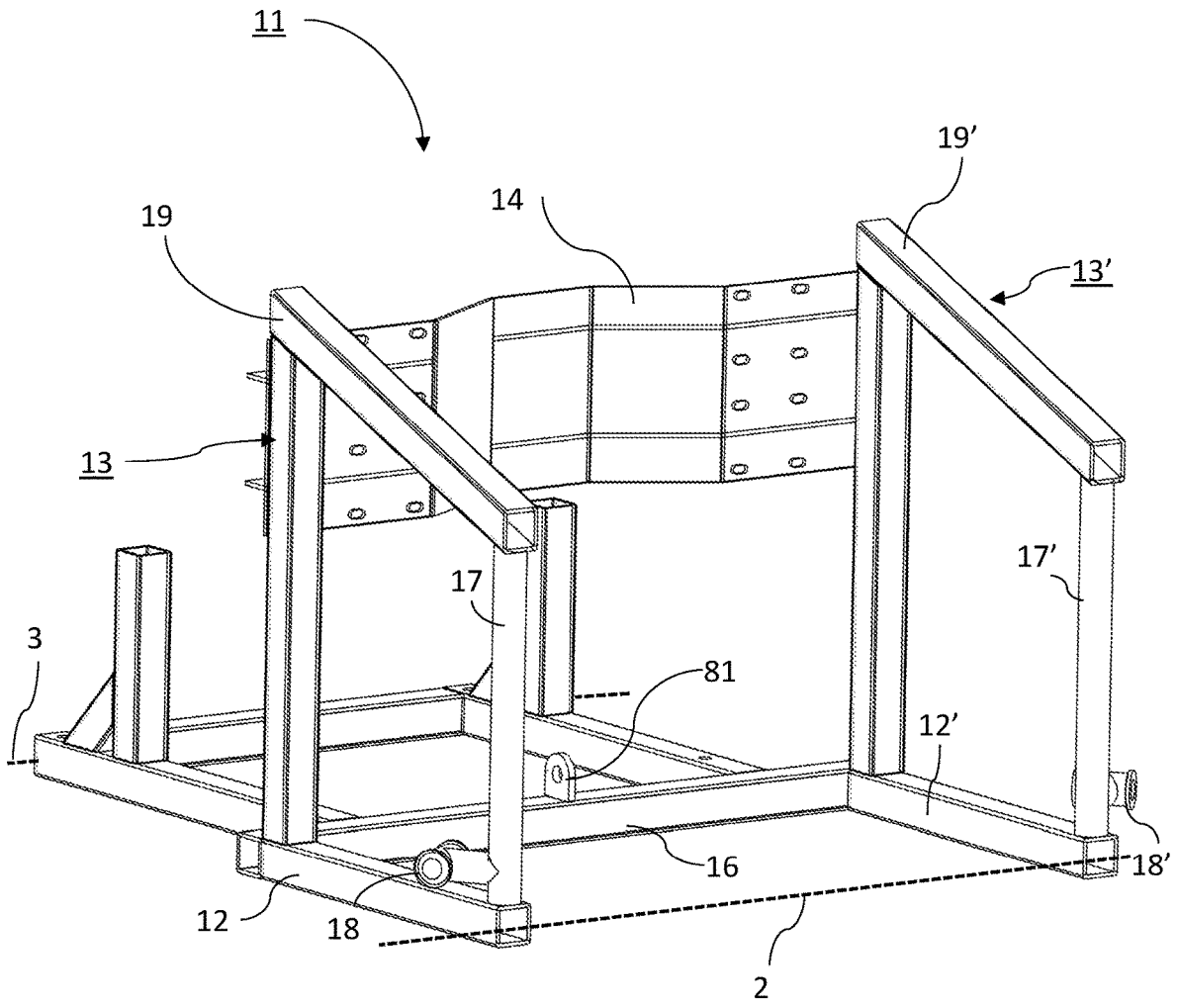
FIG. 2B depicts a support frame portion of a first embodiment of a wheelchair in accordance with the instant application wherein portions of the support frame used to mount the front wheels are positioned to rotate the front wheels toward the rear of the wheelchair to provide access to the lifting platform.
Figure 2C:
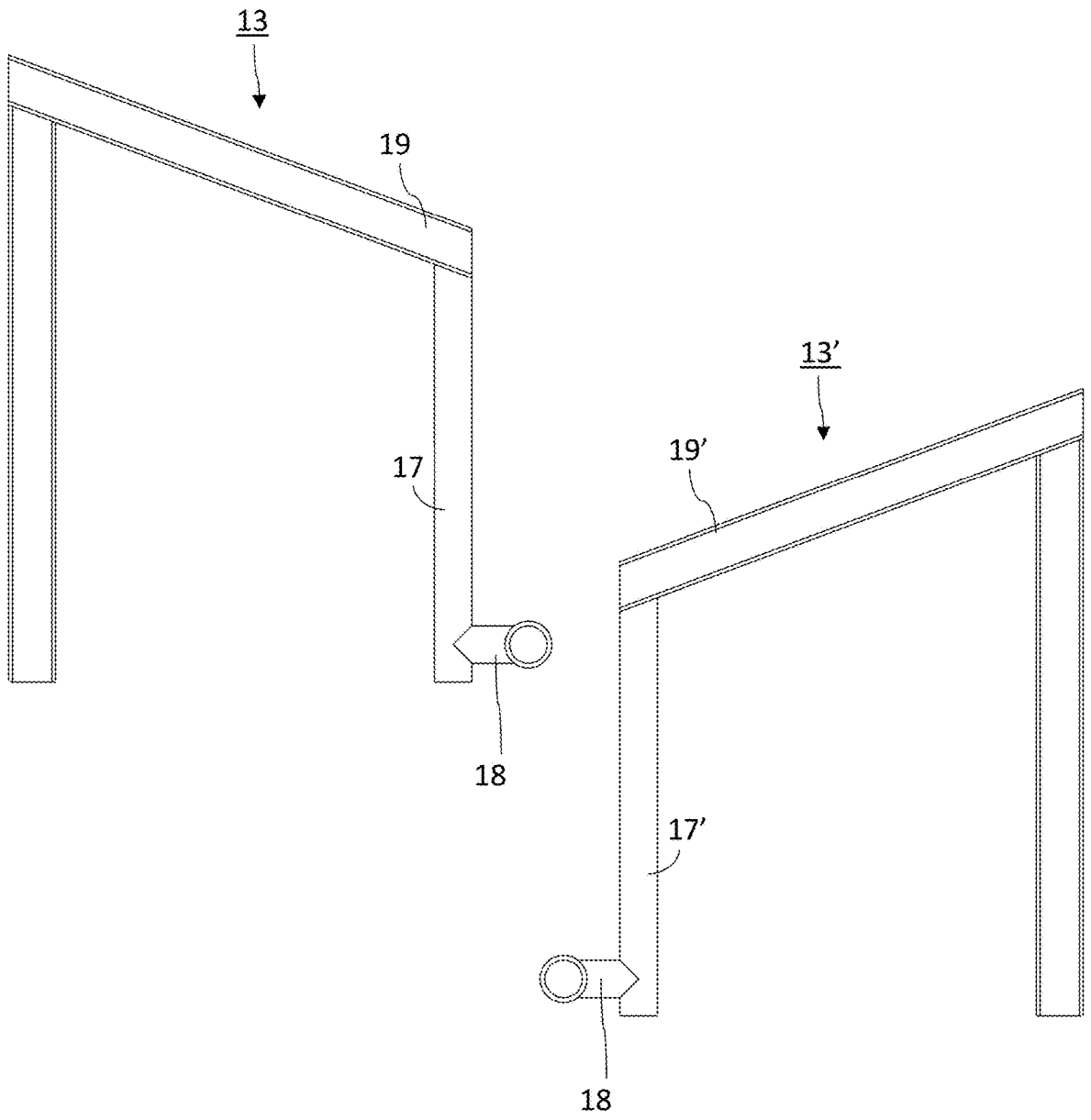
FIG. 2C depicts vertical frame members of a support frame portion of a first embodiment of a wheelchair in accordance with the instant application.

FIG. 2A depicts the position of frame member 17 with wheel mount 18, and frame member 17' with wheel mount 18' to turn front wheel housings 8, 8' and front wheels 4, 4' forward as depicted in FIGS. 1A and 1B. FIG. 2B depicts the position of frame member 17 with wheel mount 18, and frame member 17' with wheel mount 18' to rotate front wheel housings 8,8' and front wheels 4, 4' behind the front 2' (reference FIG. 4A) of seat frame 21 and toward the rear 3 of seat assembly 20 as depicted in FIGS. 1C, 1D.

With reference to FIG. 3, seat assembly 20 comprises a seat frame 21 (reference FIGS. 4A, 4B and 4C), seat pad mounting brackets 25, 25' (reference FIG. 6), seat pad frame 28 (reference FIG. 7), lift platform 29 (reference FIG. 8) and lift mechanisms 32, 33 and 33'.

Figure 4A:
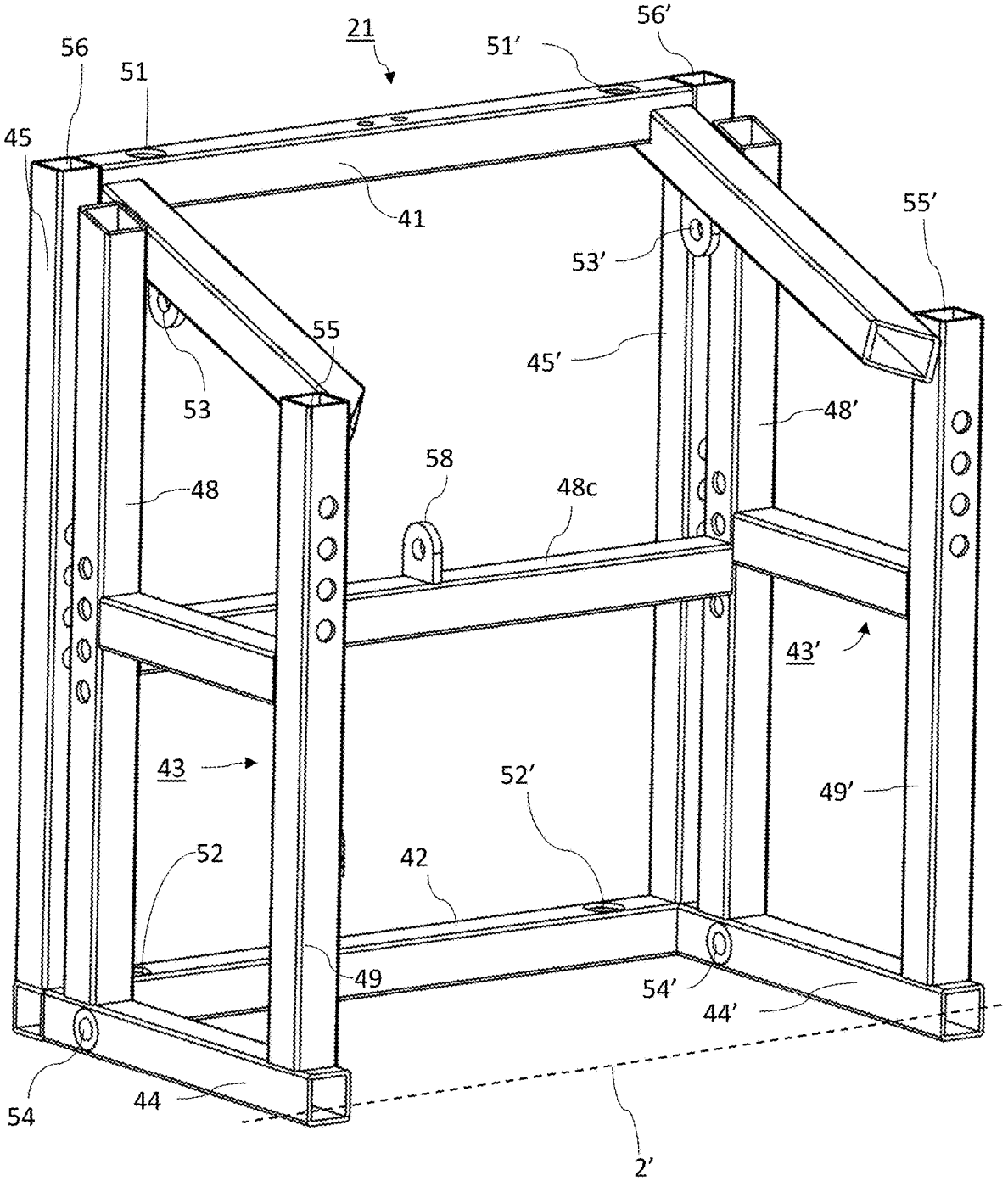
FIG. 4A depicts a seat frame portion of a wheelchair in accordance with the instant application.
Figure 4B:
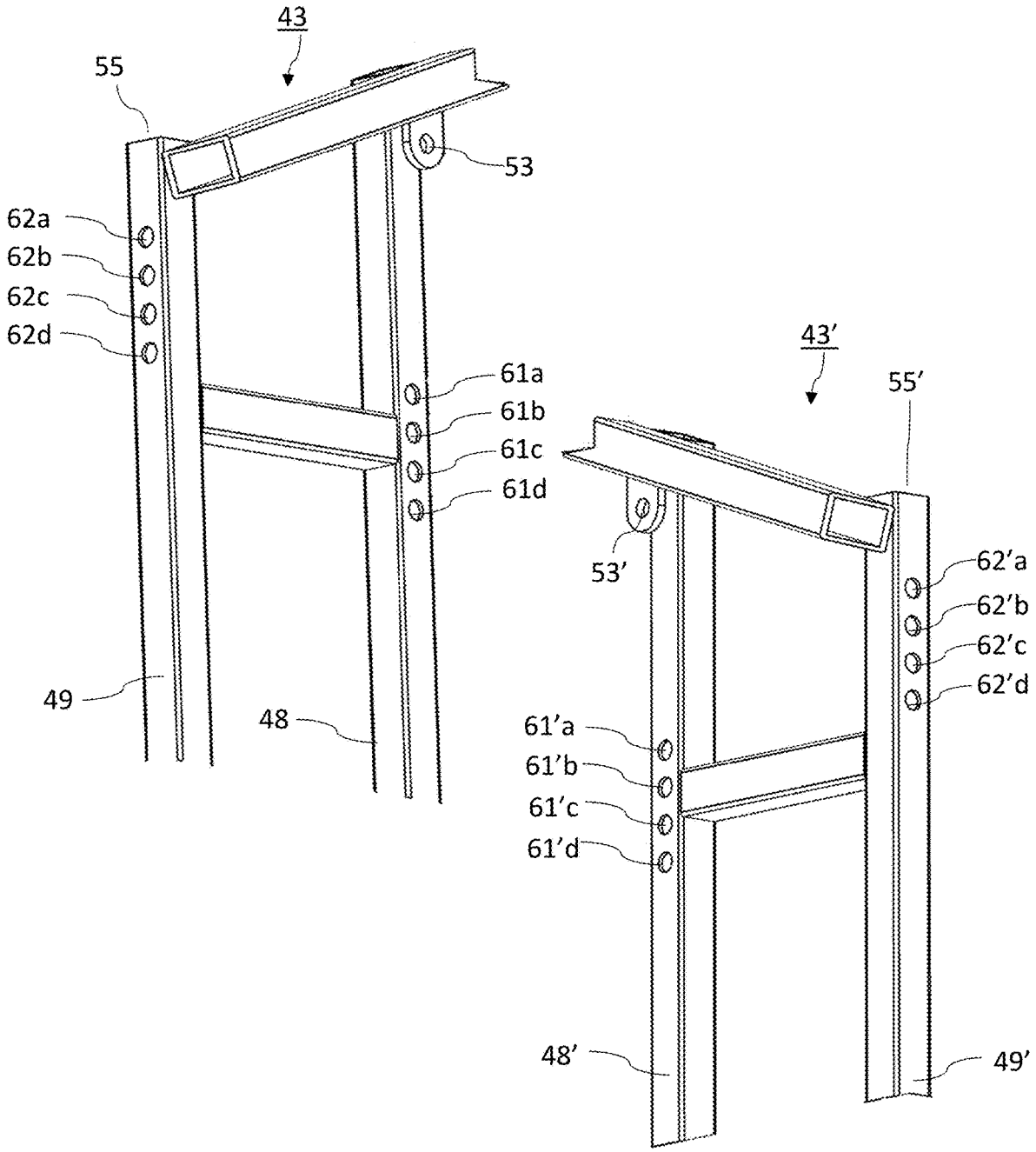
FIG. 4B depicts two members of a seat frame portion of a wheelchair in accordance with the instant application.
Figure 4C:
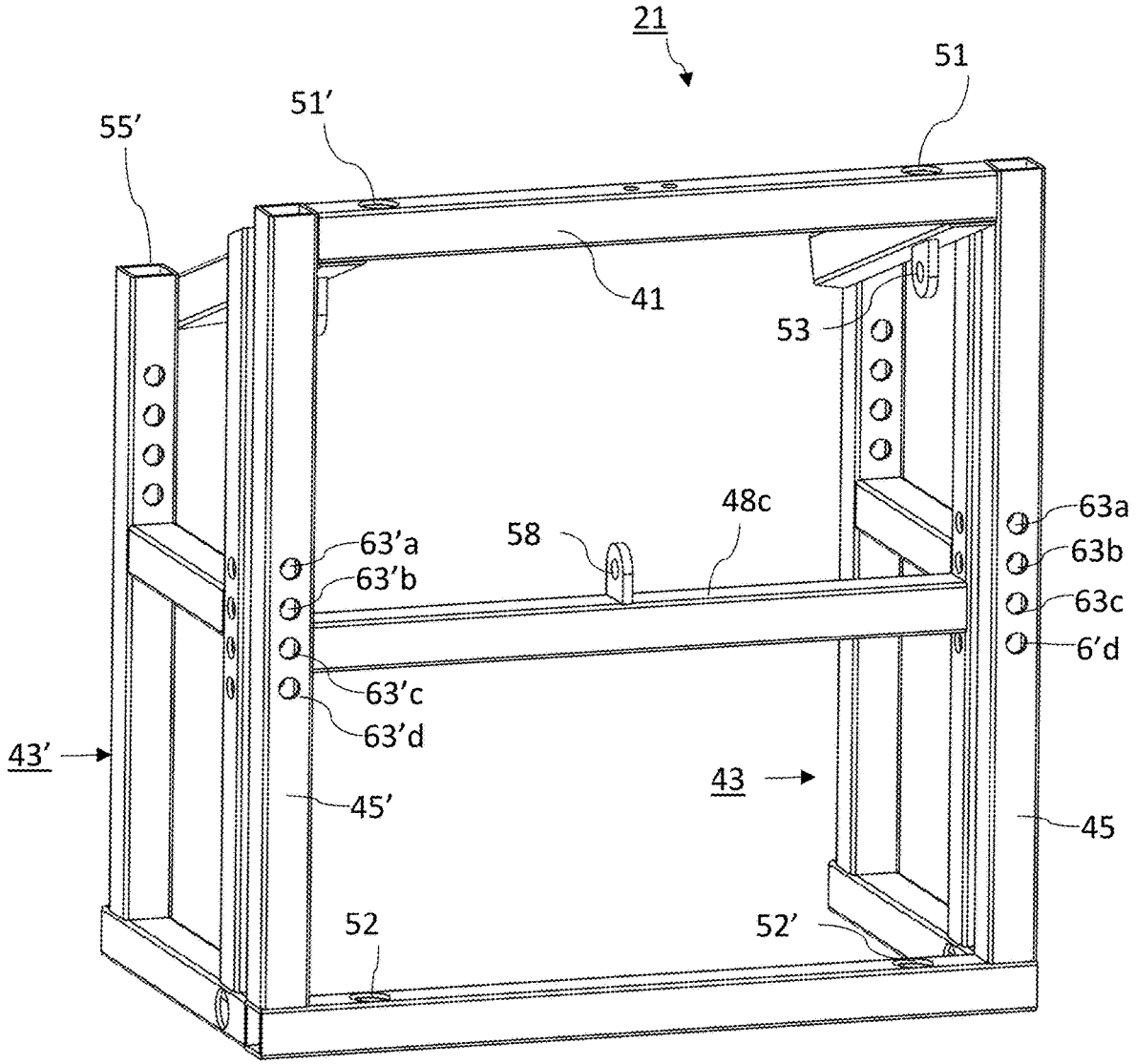
FIG. 4C depicts a seat frame portion of a wheelchair in accordance with the instant application.

With reference to FIG. 4A, seat frame 21 comprises a first horizontal frame member 44 extending from the front 2' of seat frame 21 to frame member 42, and a second horizontal frame member 44' extending from the front 2 of seat frame 21 to frame member 42. Frame members 44,44' each have one hole, 54, 54' respectively, used to rotatably couple lift platform 29 (reference FIG. 8) to seat frame 21 as described in more detail herein. A first vertical frame member 43 (reference FIG. 4B) is attached to frame member 44 and upper frame member 41. A second vertical frame member 43' (reference FIG. 4B) is attached to frame member 44' and upper frame member 51. Frame members 45, 45' extend vertically from the ends of frame member 42 and are connected to horizontal frame member 41. Frame members 41 and 42 each have two holes, 51, 51' and 52, 52' respectively, used to vertically movably couple seat assembly 20 to support frame 11 as described in more detail herein. Cross member 48*c*, a supporting frame member, is mounted horizontally between leg 48 of vertical frame member 43 and leg 49' of vertical frame member 43' using the mounting holes 61*a*, 61*b*, 61*c* and 61*d* of leg 48 and mounting holes 61'*a*, 61'*b*, 61'*c* and 61'*d* of leg 48' (reference FIG. 4B). While the current embodiment uses mounting holes, any suitable mechanism known to those skilled in the art may be used to provide attachment points for mounting cross member 48*c* to vertical frame members 43, 43', including by way of example and not limitation, brackets, clamp, bolts and the like.

Figure 6:
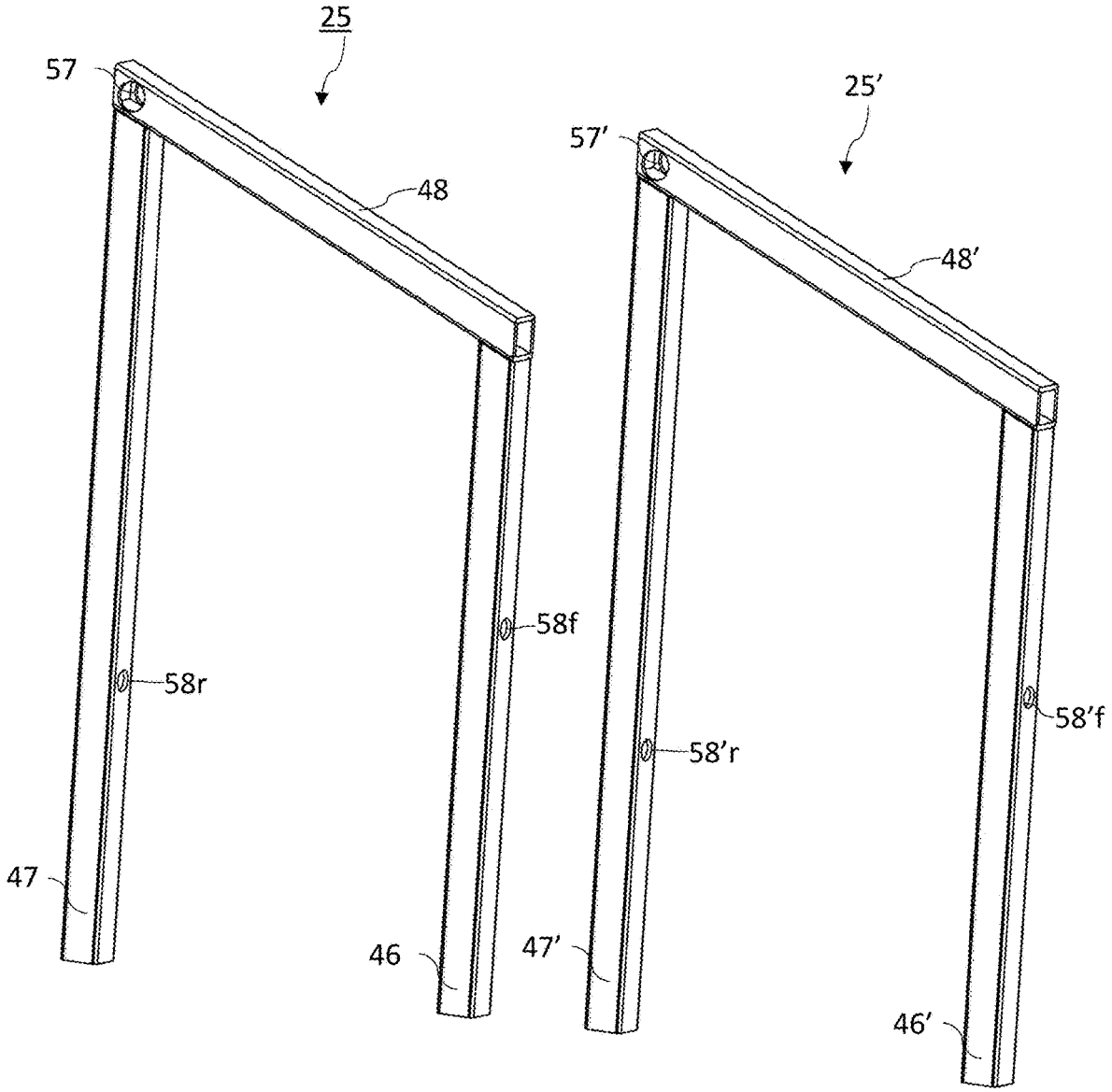
FIG. 6 depicts a seat pad height adjustment frame portion of a wheelchair in accordance with the instant application.
Figure 7:
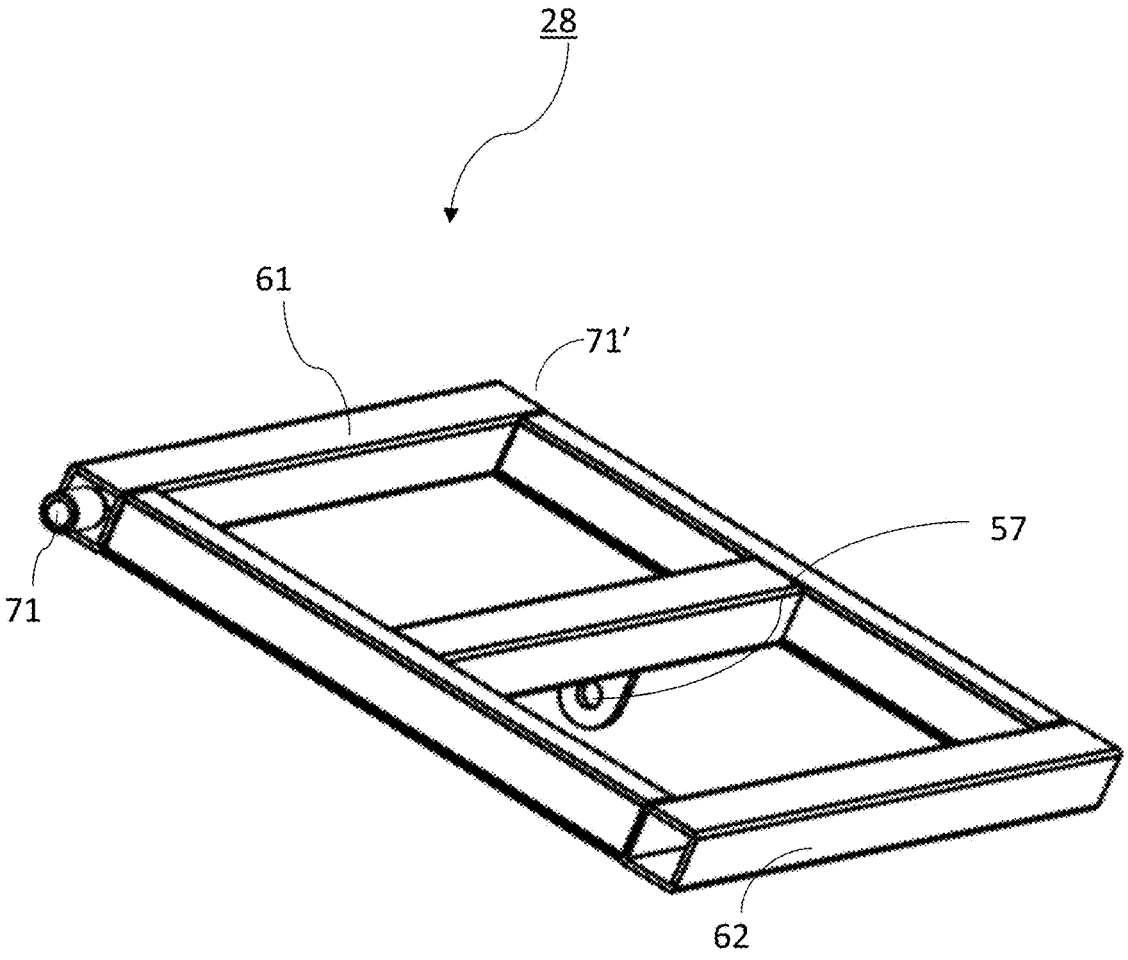
FIG. 7 depicts a seat pad frame of a wheelchair in accordance with the instant application.

Referring now to FIG. 3, seat assembly 20 further comprises seat pad mounting brackets 25, 25' shown in more detail with reference to FIG. 6. Seat pad mounting brackets 25, 25' are telescopically mounted to seat frame 21. Seat mounting bracket 25 frame member 46 fits into the open end 55 of seat frame 21 vertical frame member 43 and seat mounting bracket 25 frame member 47 fits into seat frame vertical frame member 45. Similarly, seat mounting bracket 25' frame member 46' fits into the open end 55' of seat frame 21 vertical frame member 43' and seat mounting bracket 2'5 frame member 47' fits into seat frame vertical frame member 45'. The vertical positioning of seat members 25 with respect to seat frame 21 is accomplished via alignment of mounting hole 58*r* on seat frame member 25 with one of mounting holes 63*a*, 63*b*, 63*c*, and 63*d* on frame member 45 and alignment of mounting hole 58*f* on seat frame member 25 with the corresponding mounting hole 62*a*, 62*b*, 62*c* and 62*d* on frame member 49. Similarly, the vertical positioning of seat members 25' with respect to seat frame 21 is accomplished via alignment of mounting hole 58'*r* on seat frame member 25' with one of mounting holes 63'*a*, 63'*b*, 63'*c*, and 63'*d* on frame member 45' and alignment of mounting hole 58'*f* on seat frame member 25' with the corresponding mounting hole 62'*a*, 62'*b*, 62'*c* and 62'*d* on frame member 49'. With the mounting holes thus aligned, frame members 25, 25' are secured with pins, bolts or the like. While the current embodiment uses mounting holes, any suitable mechanism known to those skilled in the art may be used to provide attachment points for adjusting the vertical position of frame members 25, 25' with respect to seat frame 21, including by way of example and not limitation, brackets, clamp and the like.

Referring now to FIGS. 5A and 5B, seat frame 21 is movably coupled to support frame 11. FIGS. 5A and 5B depict wheelchair 1 with the batteries 7, 7' and motors 6, 6' removed to permit viewing of components used to movably couple seat frame 21 to support frame 11. FIG. 5B depicts wheelchair 1 with support frame 11 frame member 14 removed to make shaft guides 15, 15' visible.

Shaft 24 extends downward through hole 51 (reference FIGS. 4A and 4C) of seat frame 21 frame member 41 and through hole 52 of seat frame 21 frame member 42. Shaft 24 has an upper collar 24*a* and lower collar 24*b* attached to shaft 24 to secure shaft 24 in place with respect to seat frame 21. Shaft 24' extends downward through hole 51' (reference FIGS. 4A and 4C) of seat frame 21 frame member 41 and through hole 52' of seat frame 21 frame member 42. Shaft 24' has an upper collar 24*a*' and lower collar 24*b*' attached to shaft 24' to secure shaft 24' in place with respect to seat frame 21.

Continuing with FIGS. 5A and 5B, shafts 24, 24' extend through shaft guides 15, 15' respectively. Shaft guides 15, 15' movably couple seat assembly 20 to support frame 11 and guide the vertical movement of seat assembly 20. Shaft guides 15, 15' are mounted to support frame 11 frame member 14.

Lift mechanism 31, arranged to raise and lower seat assembly 20, is coupled to lift mechanism attachment member 81 (reference FIG. 2A) and extends vertically upward to mount 27 affixed to seat frame 21 frame member 41. Lift mechanism 31 is powered by batteries 7, 7'. In a representative embodiment lift mechanism 31 comprises a Firgelli® Heavy Duty Rod Actuator. Other lift mechanisms known to those skilled in the art, such as by way of example and not limitation, scissor jacks, may also be used in concert with appropriate adjustment to the wheelchair structural elements.

Seat pad frame 28 is rotatably coupled to seat frame mounting brackets 25, 25' via the insertion of seat pad 28 pins 71, 71' (reference FIG. 8) inserted into bushings 57, 57' (reference FIG. 6). The rotatable coupling may be accomplished using any means known to those skilled in the art, including by way of example and not limitation, bearings, bushings, sleeves and the like. Lift mechanism 32 is coupled to seat pad mounting bracket 57 and seat frame 21 mounting bracket 58 (Reference FIG. 4A). Lift mechanism 32 is arranged to adjust the front-to-back inclination of seat pad frame 28 by pivoting, or tilting, the seat about the rotatable coupling. The pivoting motion provides for raising and lower the front of seat pad 28 in an arcuate motion as indicated by arc 91 of FIG. 3. Lift mechanism 32 is powered by batteries 7, 7'. In a representative embodiment lift mechanism 32 comprises a Firgelli® Heavy Duty Rod Actuator. Other lift mechanisms known to those skilled in the art, such as, by way of example and not limitation, scissor jacks, may also be used in concert with appropriate adjustment to the wheelchair structural elements.

Figure 8:
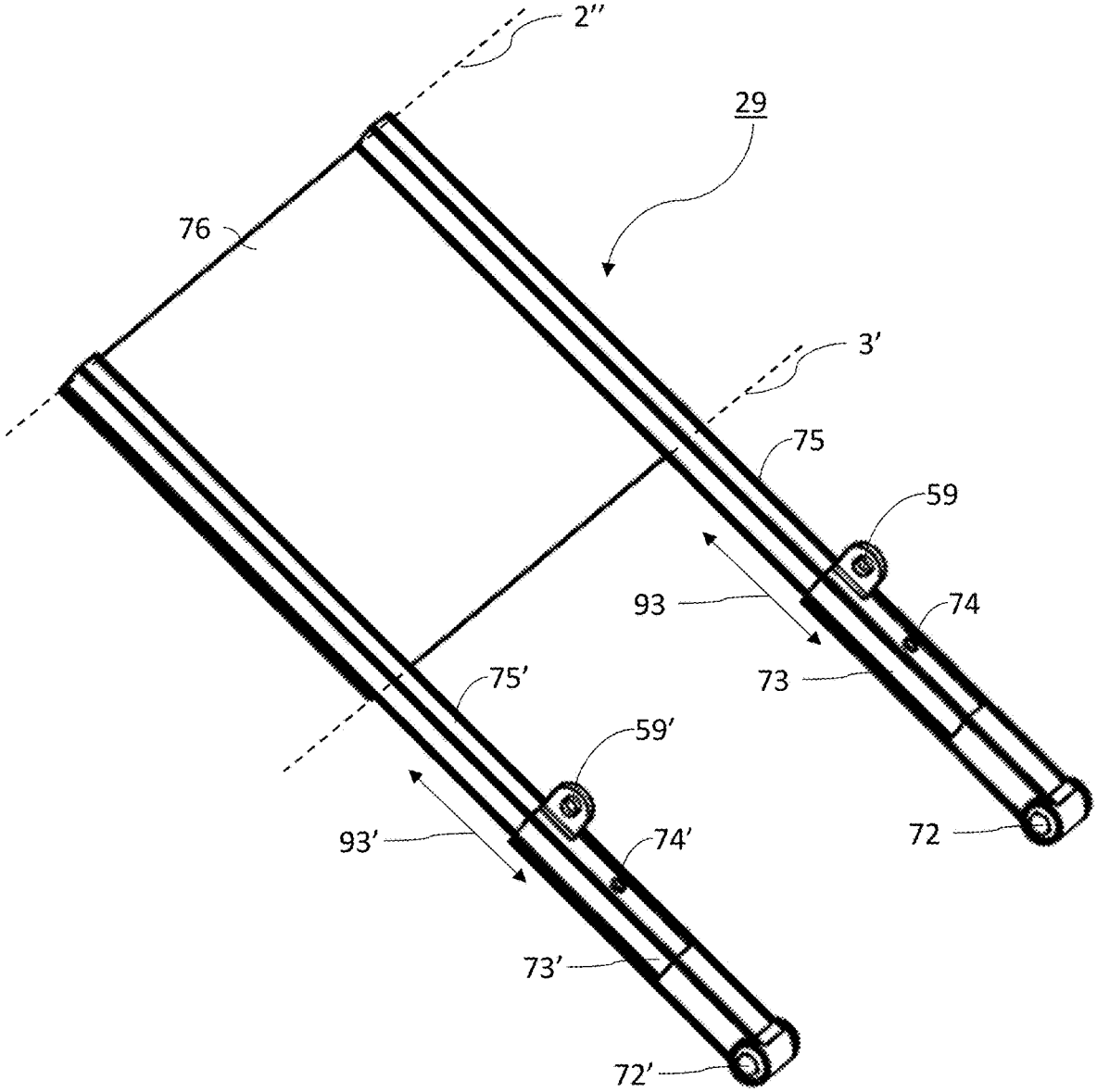
FIG. 8 depicts a knee pad frame of a wheelchair in accordance with the instant application.

Turning now to FIG. 8 there is depicted a lift platform 29 in accordance with the instant application. In a currently preferred embodiment lift platform 29 comprises a mounting pad 76, also referred to as a knee pad tray, having a front 2" and rear 3' attached to and extending between lift platform members 75, 75'. Lift platform 29 members 75, 75' slidably fit into lift platform 29 mounting brackets 73, 73' as indicated by the double-sided arrows 93, 93'. The position of the lift platform 29 members 75, 75' is fixed relative to mounting brackets 73, 73' via use of a set screw into holes 74, 74'. Mounting bracket 73 further comprises lift mechanism attachment tab 59 and mounting hole 72. Similarly, mounting bracket 73' further comprises lift mechanism attachment tab 59' and mounting hole 72'.

Continuing with FIG. 3, lift platform 29 (reference FIG. 8) is rotatably coupled to seat frame 21 by any of well-known rotatable coupling mechanisms known to those skilled in the art including by way of example and not limitation, bearings, bushings, sleeves and the like. In one embodiment, said coupling mechanism, couples lift platform 29 bushings 72, 72' with seat frame 21 mounting holes 54, 54' respectively. Lift mechanism 33 is coupled to seat frame mounting bracket 53 and lift platform 29 lift mechanism attachment tab 59. Lift mechanism 33' is coupled to seat frame mounting bracket 53' and lift platform 29 lift mechanism attachment tab 59'. Lift mechanisms 33, 33' act to raise and lower lift platform 29 in an arcuate motion as indicated by arc 92. The lift mechanisms are arranged to lower lift platform 29 to a position sufficiently close to the surface wheelchair 1 is resting upon to enable a person to crawl onto the kneepad. In a representative embodiment lift mechanisms 33, 33' comprises a Firgelli® Heavy Duty Rod Actuator. Other lift mechanisms known to those skilled in the art, such as by way of example and not limitation, scissor jacks, may also be used in concert with appropriate adjustment to the wheelchair structural elements.

Figure 9:
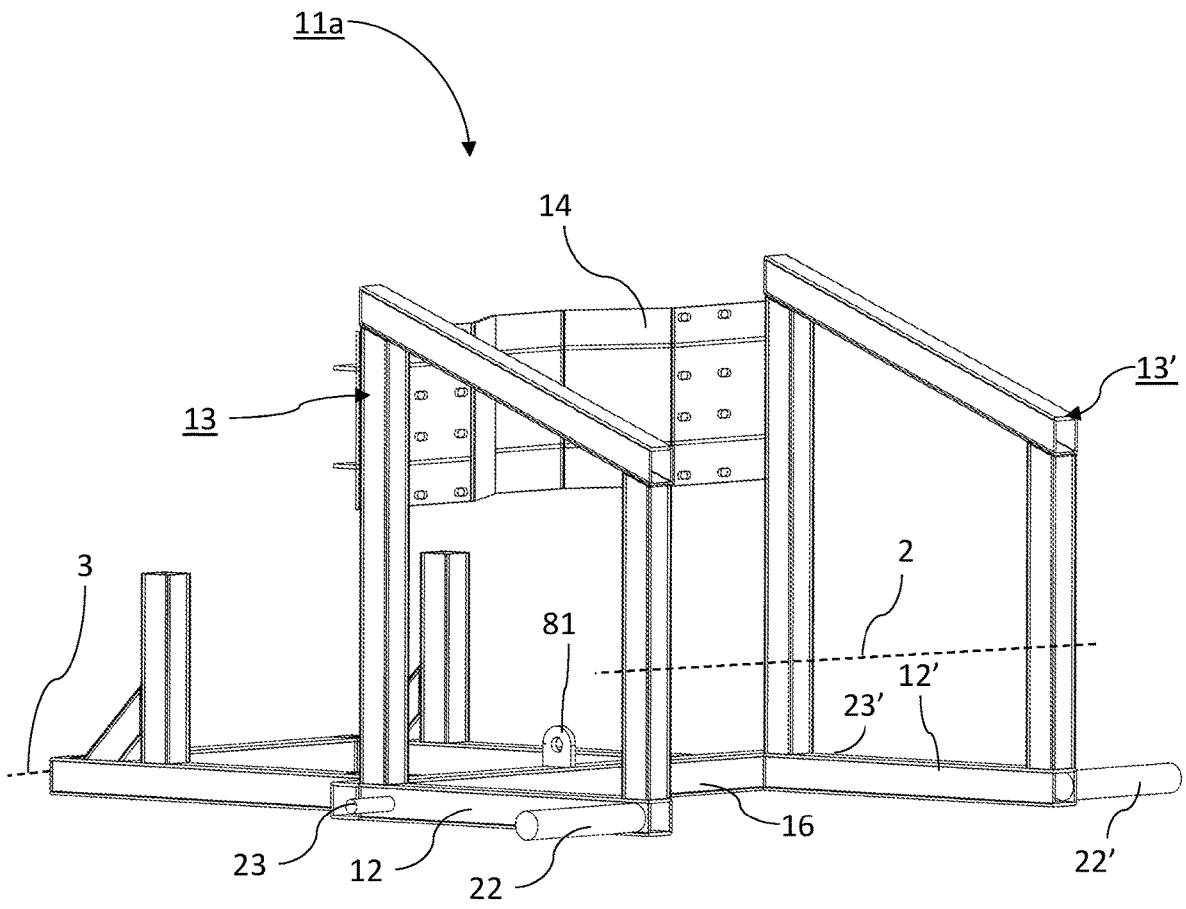
FIG. 9 depicts a support frame portion of a second embodiment of a wheelchair in accordance with the instant application.

In a second embodiment in accordance with the instant application, wheel chair 1 comprises support from 11*a* of FIG. 9. Support frame 11*a* comprises horizontal support frame members 12, 12' extending from the front 2 of support frame 11*a* toward the rear 3 of the support frame 11 where they are attached to frame member 16. Lift mechanism attachment member 81 is located midway between the two ends of frame member 16. Vertical support frame members 13, 13' (reference FIG. 2C) are attached respectively to horizontal support frame members 12 and 12'. A rear bracket 14 extends between and is attached to vertical support frame members 13, 13'. Seat assembly 20 (reference FIG. 3) is positioned between vertical support frame members 13, 13' and forward of rear bracket 14. Front wheel housings 8*a*, 8*a*' (reference FIG. 10A) are mounted to shafts 22, 22' of vertical support members 13, 13' respectively. Shafts 23,23' (23' not shown) provide attachment points for actuators 34, 34' as described in more detail herein with respect to FIGS. 10A, 10B and 10C.

Figure 10A:
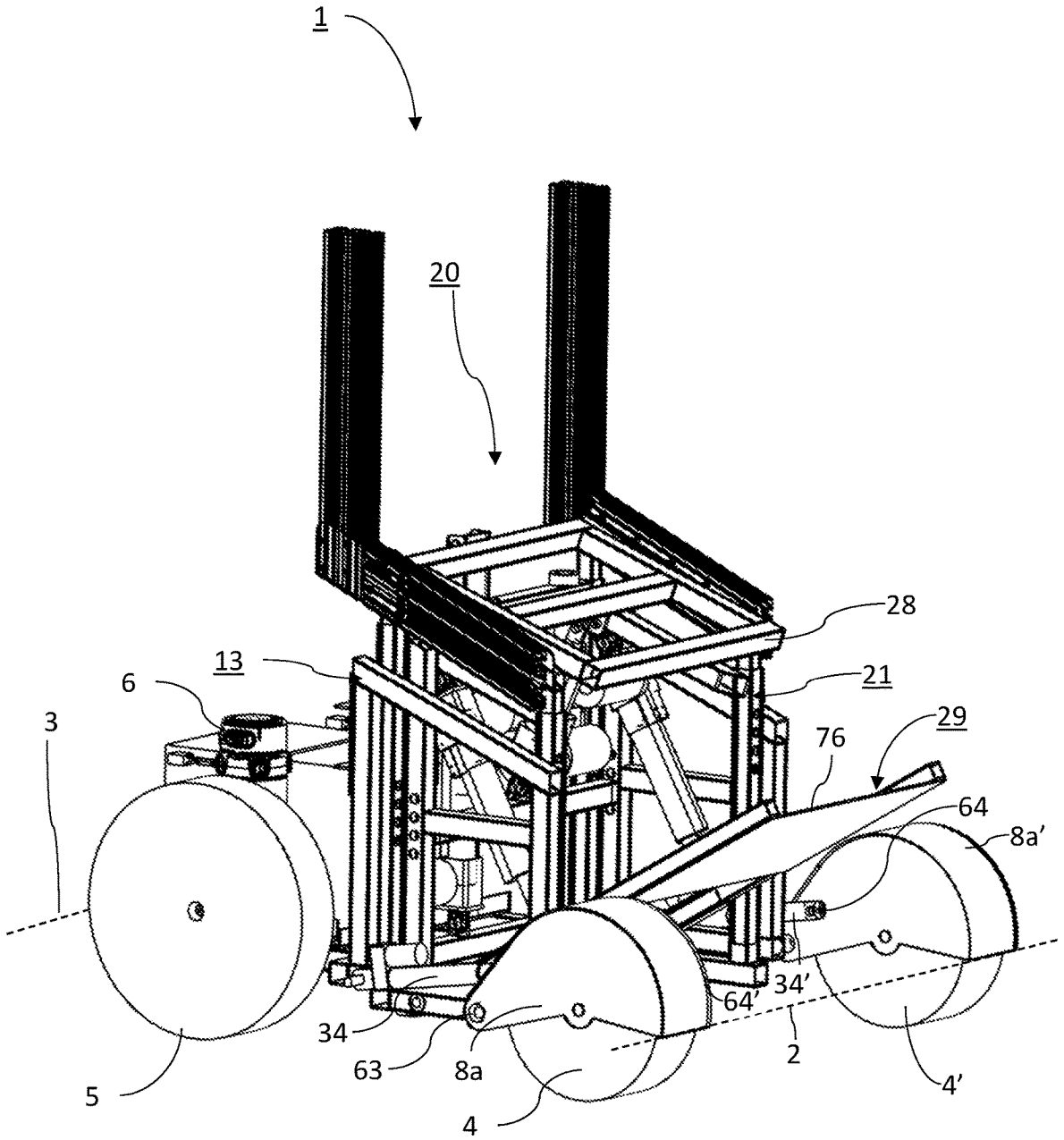
FIG. 10A depicts a side view of a second embodiment of a wheelchair in accordance with the instant application.
Figure 10B:
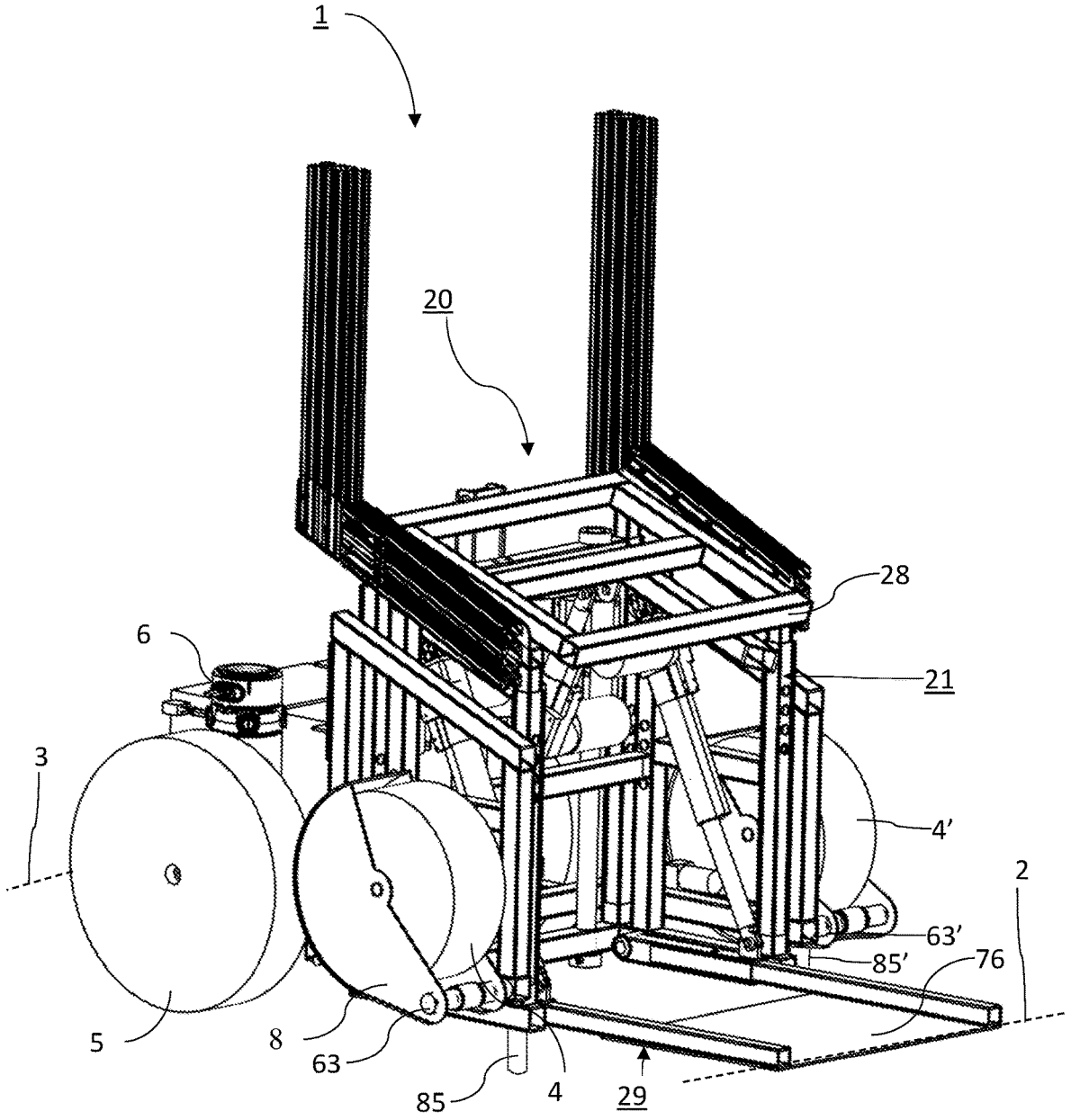
FIG. 10B depicts a side view of a second embodiment of a wheelchair in accordance with the instant application wherein the front wheels are rotated toward the rear of the wheelchair to provide access to the lifting platform.
Figure 10C:
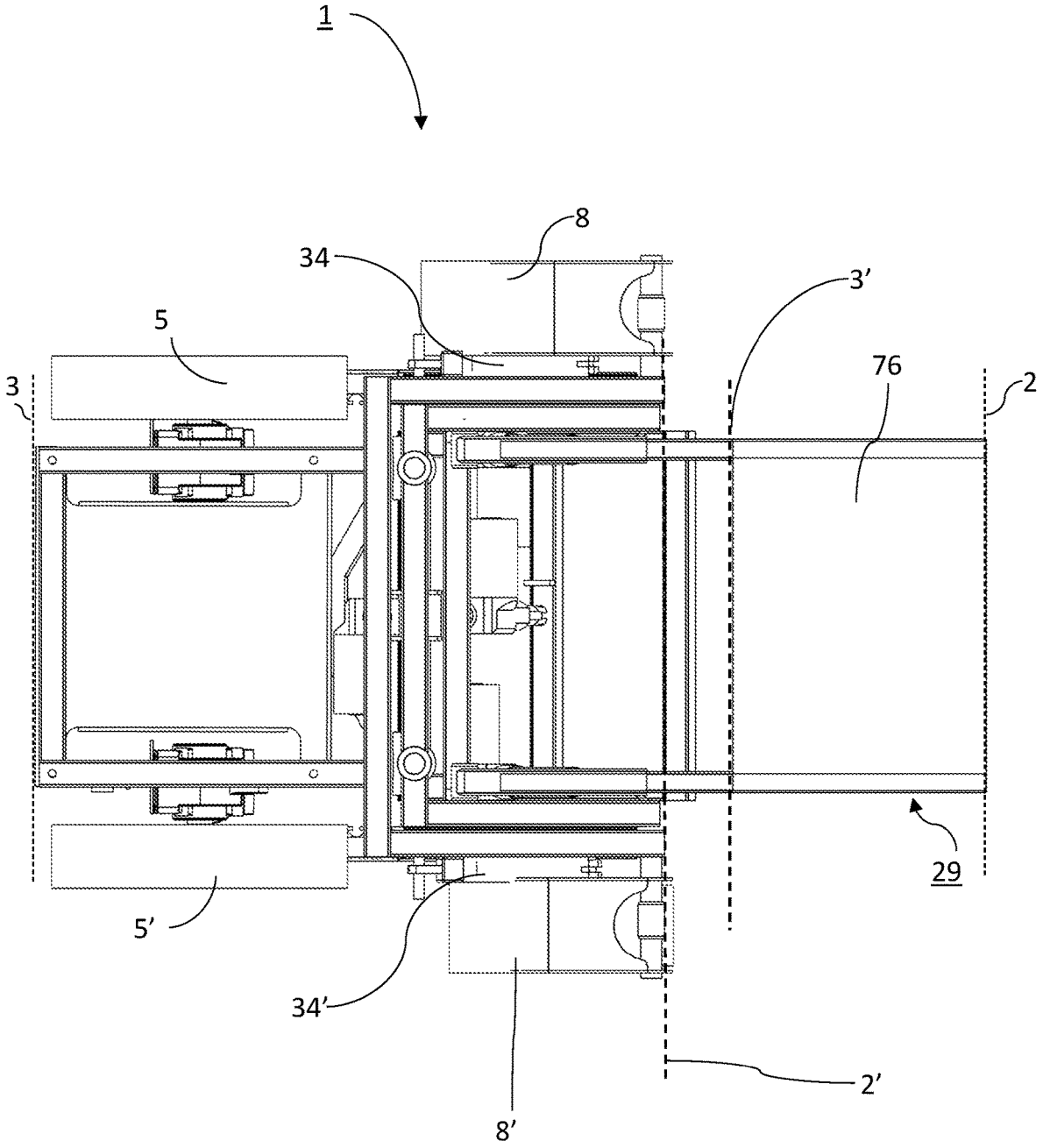
FIG. 10C depicts a bottom view of a first embodiment of a wheelchair in accordance with the instant application wherein the front wheels are rotated toward the rear of the wheelchair to provide access to the lifting platform.

Continuing with the description of a second embodiment of a wheel chair 1 in accordance with the instant application and with reference to FIGS. 10A, 10B, and 10C.wheel chair 1 comprises actuators 34, 34'. Actuators 34, 34' are attached to support frame 11*a* shafts 23, 23' and wheel housing 8*a*, 8*a'* attachment points 64, 64'. Actuators 34, 34' serve to rotate wheel housings 8*a*, 8*a'* about support frame shafts 22, 22' to position wheel housings 8*a*, 8*a'* substantially behind the front 2' of seat frame 21 and the rear of knee pad tray 76. In one embodiment optional support legs 85, 85' (reference FIG. 10B) are lowered to the surface on which wheelchair 1 resides prior to rotation of front wheels 4, 4' and wheel housing 8, 8'. In a representative embodiment, actuators 34, 34' comprise a Firgelli® Heavy Duty Rod Actuator. Other actuators are known to those skilled in the art, such as, by way of example and not limitation, servo motors used in combination with gears and appropriate modifications to wheelchair 1.

Figure 11:
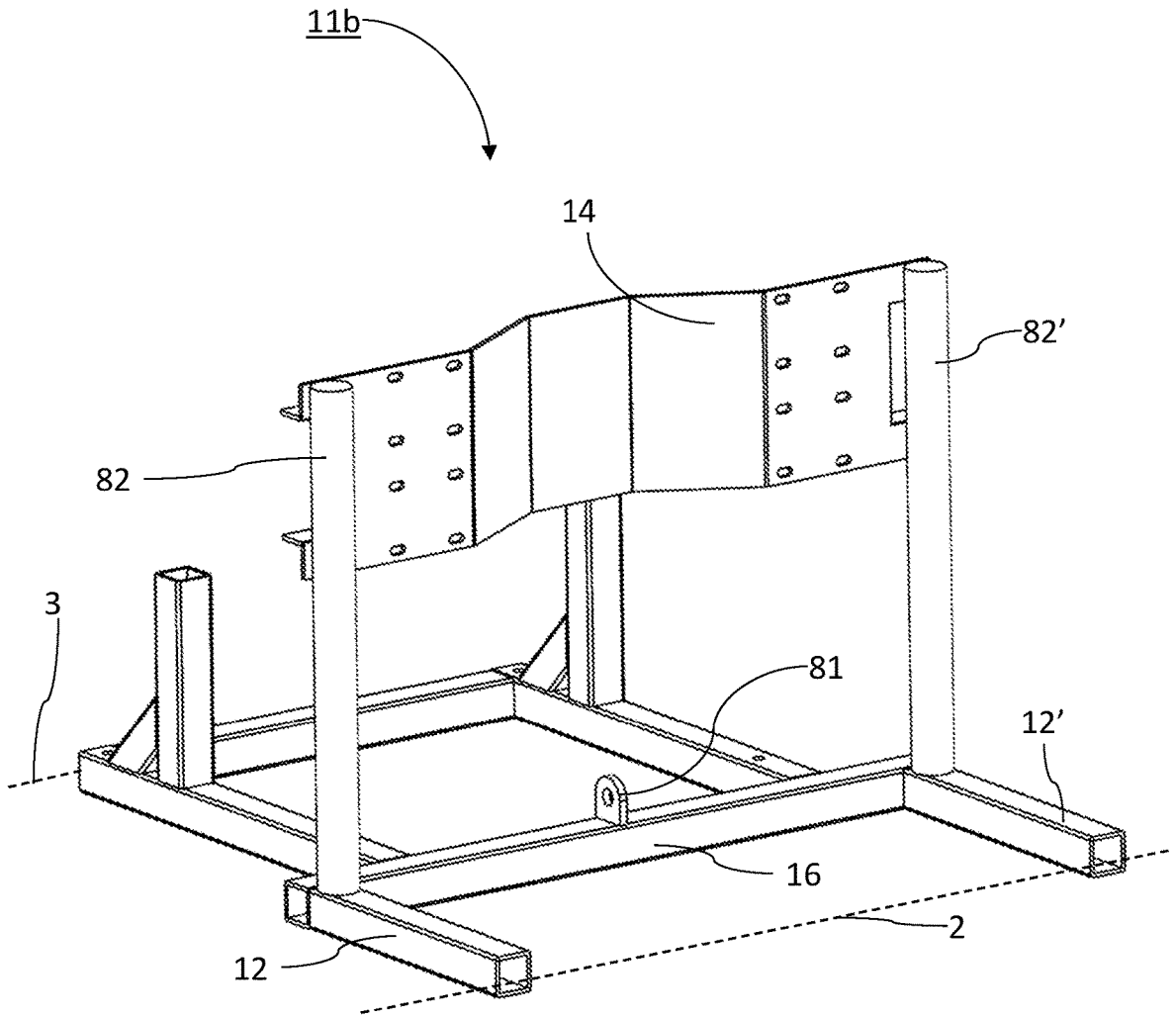
FIG. 11 depicts a support frame portion of a third embodiment of a wheelchair in accordance with the instant application.

In a third embodiment in accordance with the instant application, wheel chair 1 comprises support from 11*b* of FIG. 11. Support frame 11*b* comprises horizontal support frame members 12, 12' extending from the front 2 of support frame 11 toward the rear 3 of the support frame 11 where they are attached to frame member 16. Lift mechanism attachment member 81 is located midway between the two ends of frame member 16. Cylindrical vertical support frame members 82, 82' are attached respectively to horizontal support frame members 12 and 12'. A rear bracket 14 extends between and is attached to vertical support frame members 82, 82'. Seat assembly 20 (reference FIG. 3) is positioned between vertical support frame members 82, 82' and forward of rear bracket 14.

Figure 12A:
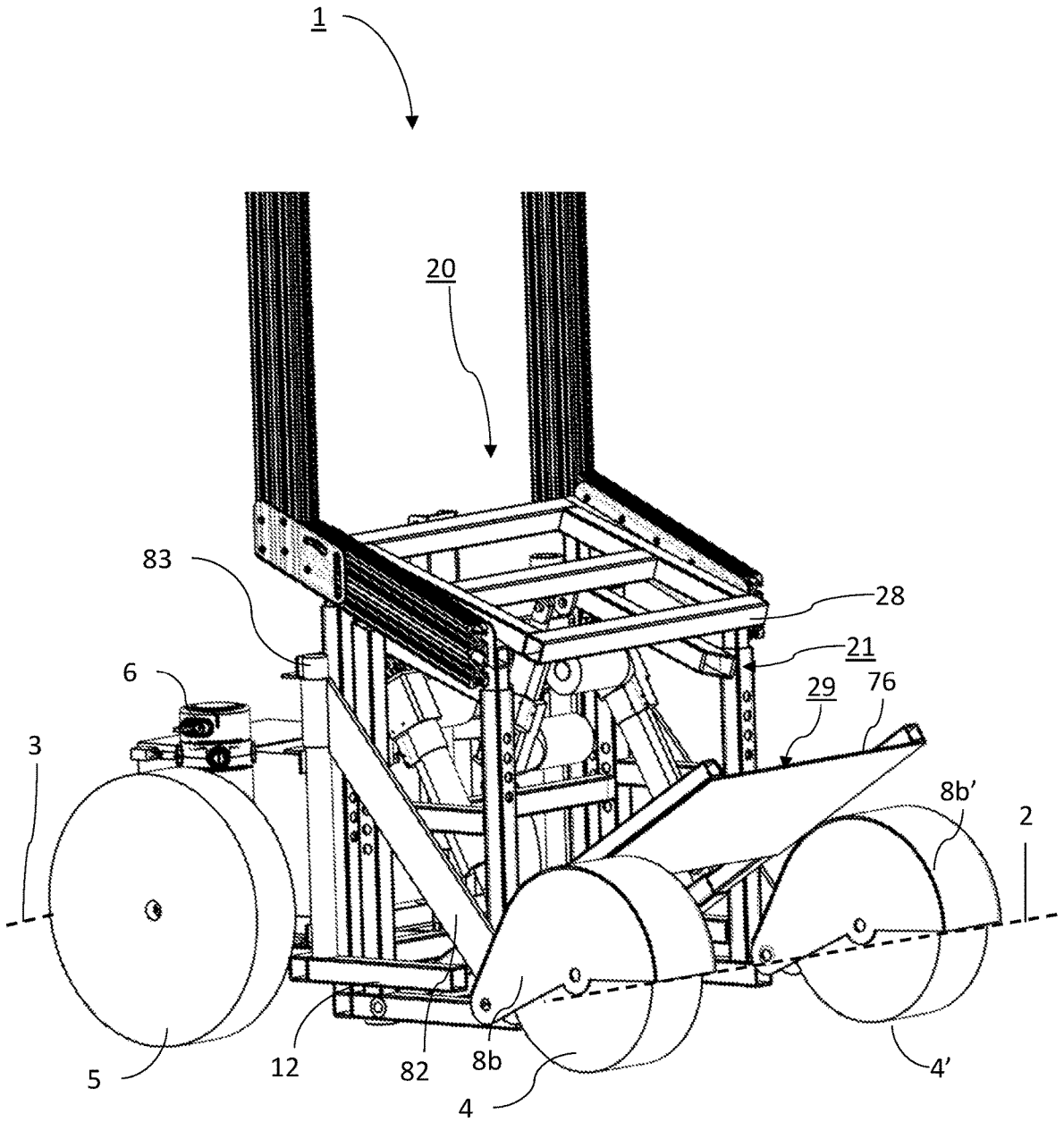
FIG. 12A depicts a side view of a third embodiment of a wheelchair in accordance with the instant application.
Figure 12B:
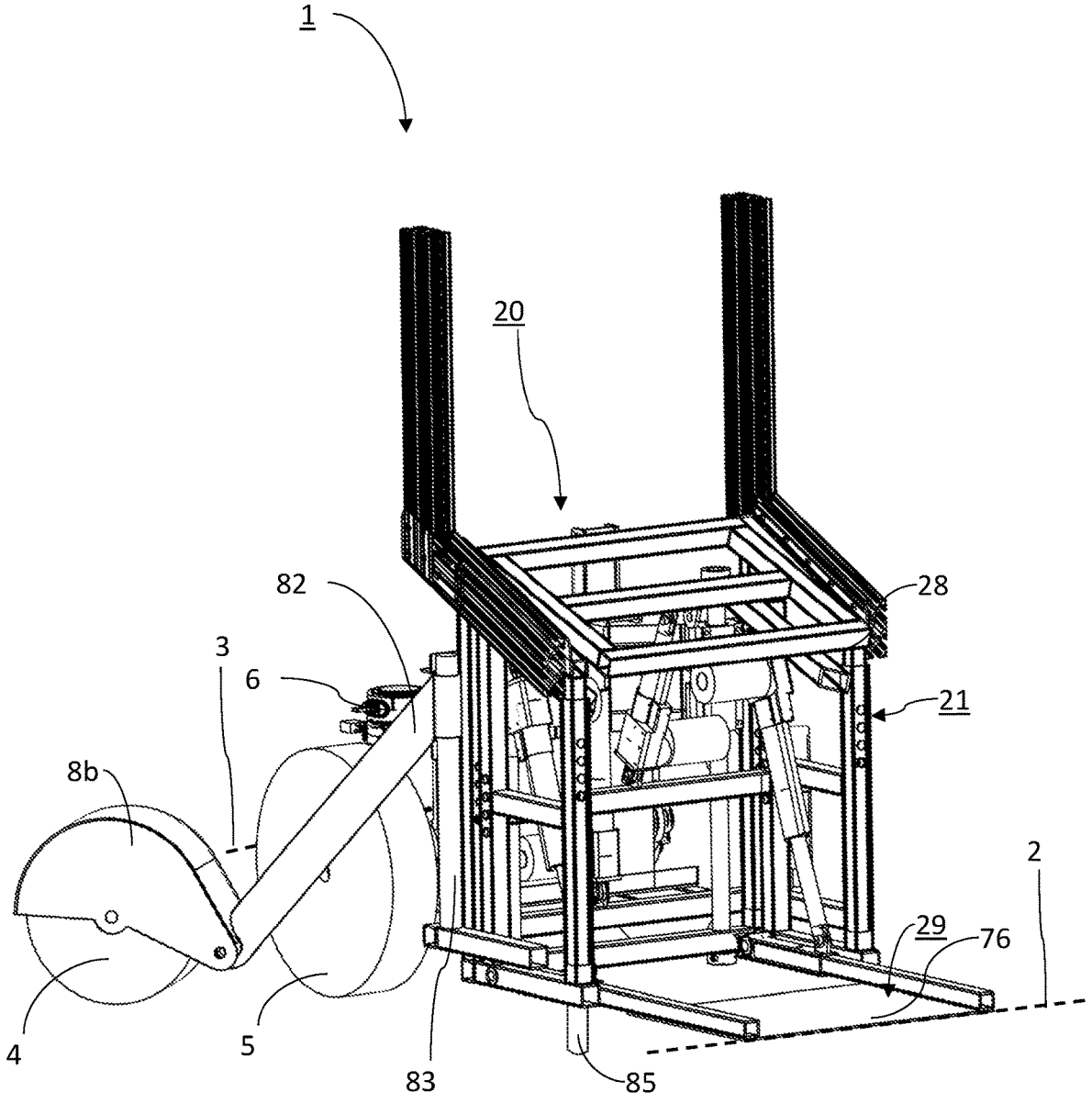
FIG. 12B depicts a side view of a third embodiment of a wheelchair in accordance with the instant application wherein the front wheels are rotated toward the rear of the wheelchair to provide access to the lifting platform.
Figure 12C:
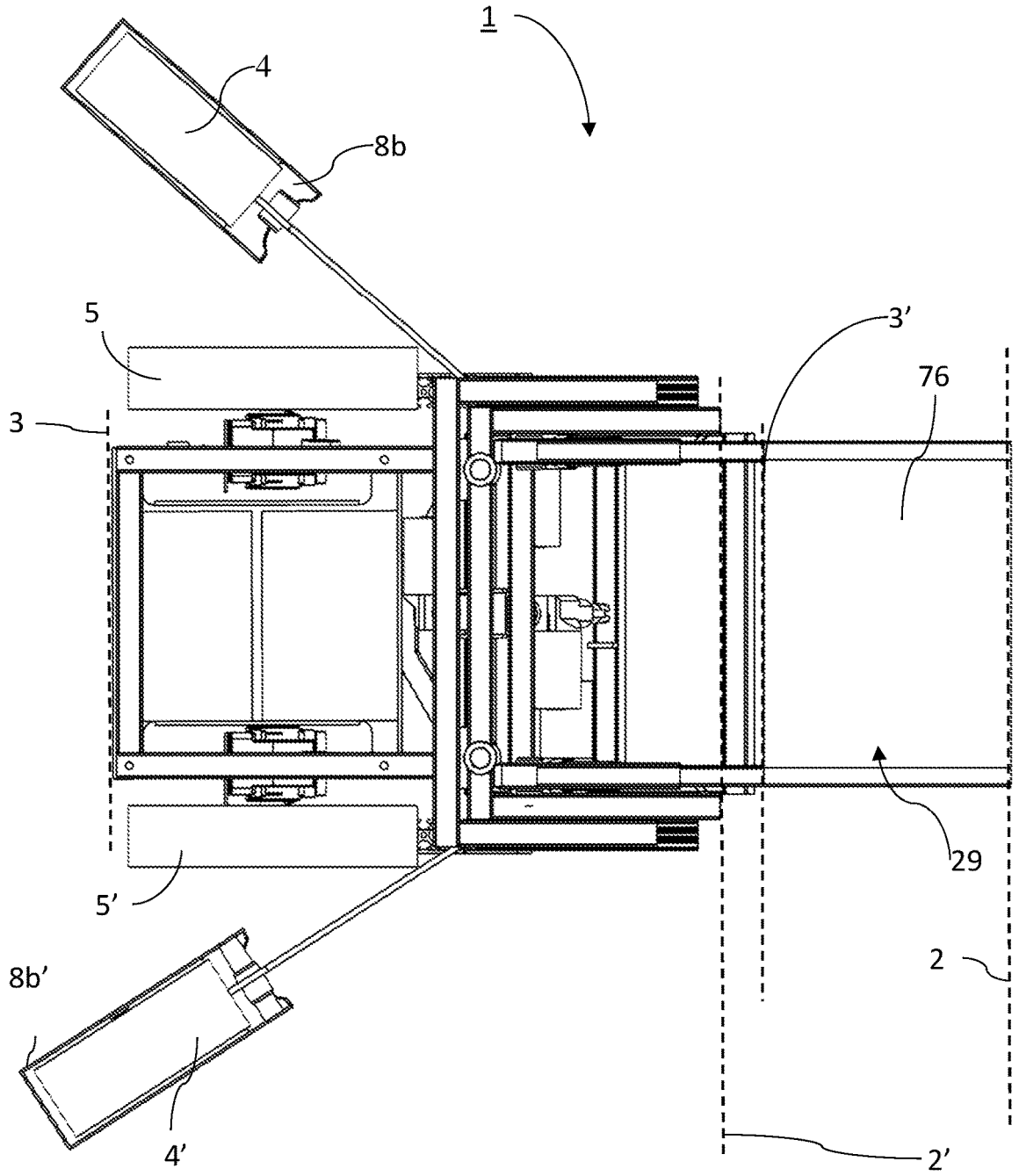
FIG. 12C depicts a bottom view of a third embodiment of a wheelchair in accordance with the instant application wherein the front wheels are rotated toward the rear of the wheelchair to provide access to the lifting platform.

Continuing with the description of a third embodiment of a wheel chair 1 in accordance with the instant application and with reference to FIGS. 12A, 12B, and 12C wheel chair 1 wheel housings 8, 8' are attached to swing arms 82, 82' respectively. Swing arms 82, 82' are arranged to rotate about cylindrical vertical support members 83, 83' enabling the wheel housings 8,8' to be positioned forward as shown with respect to FIG. 12A or rearward as shown with respect to FIGS. 12B and 12C behind the front 2' of seat frame 21 and the rear of knee pad tray 76. In one embodiment optional support legs 85, 85' (reference FIG. 12B) are lowered to the surface on which wheelchair 1 resides prior to rotation of swing arms 82, 82'.

In operation, wheelchair 1 is customized to fit the overall dimensions and needs of the individual that will be using it. With reference to FIG. 3 and FIG. 5A, lift mechanisms 31, 32, 33 and 33' are selected with sufficient motive force to accommodate the weight of the individual that will use wheelchair 1. With reference to FIG. 4A, the vertical position of cross member 48*c* in seat frame 21 is adjusted to accommodate the size of the individual and the range of elevations the individual wishes to employ while using wheelchair 1. Similarly, and with reference to FIG. 3 and FIG. 4B seat pad mounting brackets 25, 25' are positioned in vertical frame members 43, 43' to accommodate the size of the individual and the range of elevations the individual wishes to employ while using wheelchair 1. With reference to FIG. 8, the length of lift platform 29 is adjusted to accommodate the needs of the individual by adjusting the position of lift platform members 75, 75' in mounting brackets 73, 73'.

In a preferred mode of operation, and with reference to FIG. 1C in preparation for mounting wheelchair 1, seat assembly 20 is lowered via lift mechanism 32 (reference FIG. 5A, 5B) to the surface on which wheelchair 1 resides. The lowering of seat assembly 20 stabilizes wheelchair 1 for mounting. In one embodiment option support legs 85, 85' (reference FIGS. 10B, 12B) are lowered to stabilize wheelchair 1. Continuing with FIG. 1C, lift mechanisms 33, 33' are activated to lower lift platform 29 to a position sufficient to enable an individual to move onto the knee pad and sit in a kneeling position. In one mode of operation, the lift platform 29 is lowered to the surface on which wheelchair 1 is residing and so that an unassisted individual can crawl, or otherwise move, onto the knee pad tray 76 and assume a kneeling position. Lift mechanism 32 is activated to pivot seat pad frame 28 downward placing it in a position to receive the individual mounting wheelchair 1.

Optionally, as shown with respect to FIGS. 1C, one or more of front wheels 4, 4' and wheel housings 8, 8' may be positioned rearward of seat frame 21 front 2' to facilitate moving onto lift platform 29. Similarly, as shown with respect to FIG. 12*b*, one or more of front wheels 4, 4' and wheel housings 8*b*, 8*b'* may be positioned rearward of seat frame 21 front 2' to facilitate moving onto lift platform 29. Optionally, lift mechanism 32 can be used to drive seat assembly 20 downward, relieving some of the force on front wheels 4, 4' to enable positioning front wheels 4, 4' rearward as shown with respect to FIGS. 1C and 12B.

In the embodiment shown with respect to FIGS. 12A and 12B, actuators 34, 34' may be activated to position wheel 4, 4' and wheel housings 8, 8' behind front 2' of seat frame 21.

An important aspect of wheelchair 1 is the ability to position the front wheels and associated mounting hardware in a manner that provides side as well as front access to lift platform 29. While the embodiments depicted herein have described this positioning via rotation about a vertical or horizontal axis, those skilled in the art will understand that other axes of rotation can be usefully and suitably employed to accomplish this goal.

With the individual mounted in a kneeling position on lift platform 29 and seat pad frame 28 positioned to receive the individual, lift mechanisms 33, 33' are activated to lift the individual onto the seat pad frame 28. Lift platform 29 enables an individual to firmly and securely sit with seat pad frame 28 titled downward (reference FIG. 13). As the need or desires of the individual vary, seat pad frame 28 can be raised to a level position and lift platform 29 lowered to provide a conventional seating arrangement. By having an ability to adjust the seating arrangement, the individual may reduce the discomforts and associated injuries, such as to the spine and bed sores, associated with having to maintain a fixed seating arrangement for an extended time. In addition, this provides the ability to adjust posture in order to achieve a more ergonomically sound position when performing various activities.

In an alternate mode of operation to mount the wheel chair, seat pad frame 28 is placed in a level position and lift platform 29 is lowered to a position substantially close to the surface on which wheelchair 1 resides. The individual then mounts the wheelchair using any of well-known techniques, assistive or otherwise. Once seated in the chair, the individual may then raise lift platform 29 and tilt seat pad frame 28 downward as the need or desire arises.

By activation of lift mechanism 31, the individual may vary the height at which he or she is sitting without having to adjust the position of seat pad frame 28 or lift platform 29 to compensate for the height adjustment. As shown with reference to FIGS. 3, 5A and 5B, lift mechanism 31 lifts the entire seat assembly 20.

Figure 13:
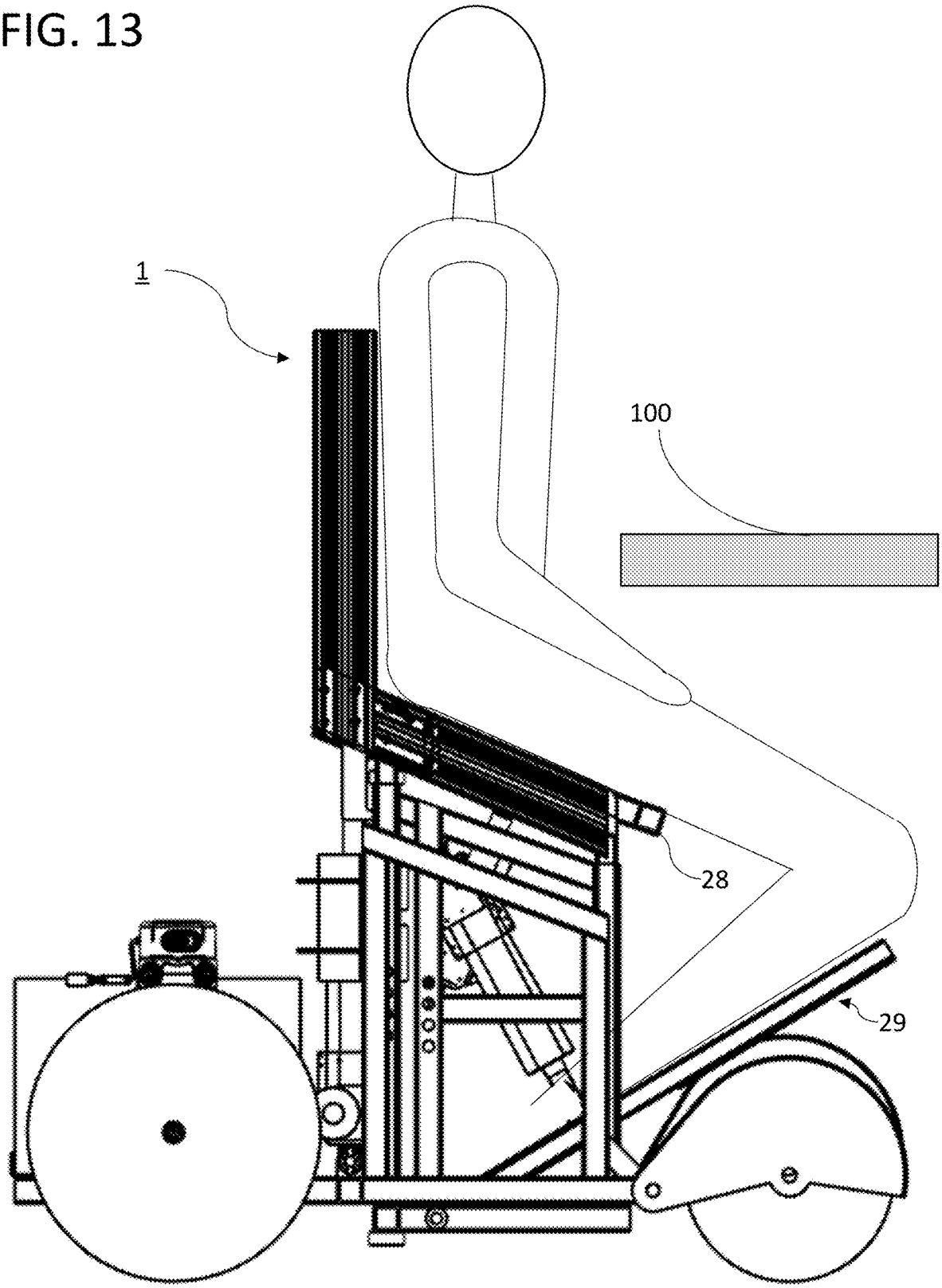
FIG. 13 depicts a person sitting in a wheelchair in accordance with the instant application.

As shown with reference to FIG. 13, a further advantage of wheelchair 1, is that by appropriate adjustment of the height of seat assembly 20, and the tilt of seat pad frame 28 and knee pad 29, an individual may sit in closer proximity to a table or other surface, such as a laboratory or workshop bench 100.

Thus have been shown several illustrative and presently preferred embodiments as described hereinabove. It is to be understood that the written descriptions and figures herein presented are intended to be illustrative and not limiting with respect to other embodiments that fall within the scope of the invention described herein, and that the appended claims encompass such embodiments except insofar as limited by prior art.

What is claimed is:

1. A wheelchair for use by an individual, the wheelchair comprising:

a) a seat frame having a front, a rear, a first side and a second side;

b) a first lift mechanism arranged to vertically move said seat frame;

c) a seat having a front and a rear wherein said seat is pivotally coupled to said seat frame allowing said front of said seat to move upward and downward in an arcuate path;

d) a second lift mechanism arranged to pivotally move said seat;

e) a lift platform, movably connected to said seat frame; and, f) a third lift mechanism arranged to move said lift platform with said individual residing on said lift platform.

2. The wheelchair of claim 1 wherein said lift platform has a front and a rear, said front of said lift platform extending out from said front of said seat frame and said third lift mechanism is arranged to pivotally move said front of said lift platform upward and downward in an arcuate path.

3. The wheelchair of claim 1 wherein said lift platform has a front and a rear, said front of said lift platform extending out from said front of said seat frame, said lift platform further comprising a mounting pad positioned on said lift platform, said wheelchair further comprising a front wheel, said front wheel rotatably coupled to said wheelchair wherein said rotatable coupling permits said front wheel to rotate about a vertical axis such that said front wheel can be positioned behind said mounting pad.

4. The wheelchair of claim 1 wherein said lift platform has a front and a rear, said front of said lift platform extending out from said front of said seat frame, said lift platform further comprising a mounting pad positioned on said lift platform, said wheelchair further comprising a front wheel, said front wheel rotatably coupled to said wheelchair wherein said rotatable coupling permits said front wheel to rotate about a horizontal axis such that said front wheel can be positioned behind said front of said mounting pad.

5. The wheelchair of claim 4 further comprising a fourth lift mechanism arranged to rotatably move said front wheel.

6. The wheelchair of claim 1 wherein said seat frame further comprises:

a) a first vertical frame member;

b) a second vertical frame member;

c) a cross member, said cross member attached to said first vertical frame member and said second vertical member;

d) wherein, said second lift mechanism is attached to said cross member and to said seat.

7. The wheelchair of claim 6 wherein said first vertical frame member has two or more vertically distinct positions to attach said cross member and said second vertical member has two or more vertically distinct positions to attach said cross frame member.

8. The wheelchair of claim 7 wherein mounting holes are provided at said two or more vertically distinct positions to attach said cross member to said first vertical member and mounting holes are provided at said two or more vertically distinct positions to attach said cross member to said second vertical member.

9. The wheelchair of claim 1 wherein said seat frame further comprises:

a) a first vertical member, a second vertical member, a first seat mounting member and a second seat mounting member;

b) said seat pivotally coupled to said seat frame having a first side and a second side, said seat pivotally coupled on said first side to said first seat mounting member and pivotally coupled on said second side to said second seat mounting member;

c) said first seat mounting member, vertically adjustably coupled to said first vertical member and said second seat mounting member vertically adjustable coupled to said second vertical member.

10. The wheelchair of claim 9 wherein said first seat mounting member vertically adjustably coupled to said first vertical member is telescopically coupled.

11. The wheelchair of claim 1 wherein said seat frame further comprises:

a) a first vertical member, a second vertical member, a first seat mounting member and a second seat mounting member;

b) said seat movably coupled to said seat frame having a front, a rear, a first side and a second side, said seat being pivotally coupled on said first side to said first seat mounting member and pivotally coupled on second side to said second seat mounting member;

c) said first seat mounting member, vertically adjustably coupled to said first vertical member and said second seat mounting member vertically adjustable to said second vertical member.

12. An assistive mobility device having a front, a rear a first side and a second side comprising:

a) a seat frame, said seat frame comprising a first seat frame member extending from said front toward said rear and a first vertical seat frame member attached to and extending upward from said first seat frame member, said seat frame further comprising a second seat frame member extending from said front toward said side, and a second vertical seat frame member attached to and extending upward from said second seat frame member;

b) a first lift mechanism arranged to vertically move said seat frame;

c) a seat movably mounted to said seat frame;

d) a second lift mechanism arranged to move said seat pad;

e) a knee pad movably connected to said seat frame, said knee pad having a front and a rear, said front of said knee pad extending out from said front of said seat frame; and, f) a third lift mechanism to move said knee pad arranged to pivotally move said front of said knee pad upward and downward in an arcuate path.

13. The wheelchair of claim 12 further comprising a front wheel, said front wheel movably coupled to said wheelchair such that the majority of said front wheel can be positioned behind said front of said seat frame.

14. The wheelchair of claim 13 wherein said front wheel movably coupled to said wheelchair is rotatably coupled to rotate about a vertical axis.

15. The wheelchair of claim 14 wherein said front wheel movably coupled to said wheelchair is rotatably coupled to rotate about a horizontal axis.

16. The wheelchair of claim 12, wherein said seat movably mounted to said seat frame further comprises a front and a rear, said seat being pivotally coupled to said seat frame allowing said front of said seat to move upward and downward in an arcuate path.

17. A wheelchair, the wheelchair comprising:

a) a seat frame;

b) a seat having a front wherein said seat is pivotally coupled to said seat frame allowing said front of said seat to move upward and downward in an arcuate path;

c) a first battery-powered lift mechanism arranged to pivotally move said seat;

d) a lift platform, movably connected to said wheelchair;

e) a second battery-powered lift mechanism arranged to pivotally move said lift platform upward and downward in an arcuate path;

f) a third lift mechanism arranged to vertically move said seat frame;

g) a mounting pad having a front and a rear; and, h) a front wheel, said front wheel rotatably coupled to said wheelchair wherein said rotatable coupling permits said front wheel to rotate such that said front wheel can be positioned behind said rear of said mounting pad.

* * * * *